US008151750B2

(12) United States Patent
Fukami et al.

(10) Patent No.: US 8,151,750 B2
(45) Date of Patent: Apr. 10, 2012

(54) VALVE OPERATING DEVICE FOR INTERNAL COMBUSTION ENGINE

(75) Inventors: Toru Fukami, Yokosuka (JP); Shinichi Takemura, Yokohama (JP); Tsuyoshi Arinaga, Yokosuka (JP); Takanobu Sugiyama, Yokohama (JP); Shunichi Aoyama, Yokosuka (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 314 days.

(21) Appl. No.: 12/527,250

(22) PCT Filed: Sep. 18, 2007

(86) PCT No.: PCT/JP2007/068601

§ 371 (c)(1),
(2), (4) Date: Aug. 14, 2009

(87) PCT Pub. No.: WO2008/114469

PCT Pub. Date: Sep. 25, 2008

(65) Prior Publication Data

US 2010/0083923 A1 Apr. 8, 2010

(30) Foreign Application Priority Data

Mar. 16, 2007 (JP) ..... 2007-068130

(51) Int. Cl.
*F01L 1/34* (2006.01)

(52) U.S. Cl. ..... 123/90.16; 123/90.39; 74/569

(58) Field of Classification Search ..... 123/90.15, 123/90.16, 90.39; 74/569, 559
See application file for complete search history.

(56) References Cited

U.S. PATENT DOCUMENTS

| | | | | |
|---|---|---|---|---|
| 2,954,017 | A | 9/1960 | Forstner | |
| 4,594,972 | A * | 6/1986 | Ma | 123/90.24 |
| 6,029,618 | A | 2/2000 | Hara et al. | |

FOREIGN PATENT DOCUMENTS

| | | | |
|---|---|---|---|
| EP | 1 715 144 | A1 | 10/2006 |
| JP | 57-142102 | U | 9/1982 |
| JP | 2004-204822 | A | 7/2004 |
| JP | 2005-291172 | A | 10/2005 |
| WO | WO 2005-075798 | A1 | 8/2005 |

* cited by examiner

*Primary Examiner* — Zelalem Eshete
(74) *Attorney, Agent, or Firm* — Foley & Lardner LLP

(57) ABSTRACT

A valve operating device that opens and closes a valve of an internal combustion engine by driving a valve stem in an axial direction includes a rocker cam that rocks in accordance with a rotation of a drive shaft and has a driving cam portion and a lift restricting cam portion; a cam follower that lifts the valve by contacting the driving cam portion slidingly; and a restricting member that prevents the cam follower from separating from the driving cam portion in cooperation with the lift restricting cam portion. A gap is formed between the restricting member and the rocker cam in a state where the cam follower is in contact with the driving cam portion and disappears such that the restricting member and the rocker cam come into contact with each other only when the cam follower separates from the driving cam portion.

28 Claims, 22 Drawing Sheets

VALVE NOT LIFTED
VALVE FULLY LIFTED
225
231
232c
220
221
221c
210
212
213
211
241
242
243
240
244
245
202a
202
202b
202c
203
203c
B
D4
D5
D6

VALVE OPERATING DEVICE FOR INTERNAL COMBUSTION ENGINE

TECHNICAL FIELD OF THE INVENTION

This invention relates to a valve operating device for an internal combustion engine.

BACKGROUND OF THE INVENTION

With regard to a valve operating device for lifting a valve of an internal combustion engine provided in a vehicle or the like, JP2004-204822A, published by the Japan Patent Office in 2004, discloses a valve operating device that lifts a valve by causing a rocker cam to contact a rocker arm such that a stem end of a valve stem contacting the rocker arm is pushed.

The valve stem is biased in a direction for closing the valve by a valve spring. When the rocker cam pushes the rocker arm, the valve stem is pushed down while causing the valve spring to contract. As the valve stem is pushed down, the valve opens.

When the pressure applied to the rocker arm by the rocker cam is released, the valve is pushed up by a spring force of the valve spring, thereby closing the valve. The valve spring keeps the rocker arm pressed against the rocker cam via the valve stem so that the rocker arm does not separate from the rocker cam as the rocker cam rocks.

SUMMARY OF THE INVENTION

When a load of the internal combustion engine is high such that a valve lift is large, a rocking acceleration of the rocker cam increases such that a large inertial force acts on the rocker arm pressed against the rocker cam. When this inertial force exceeds the spring force of the valve spring, the rocker arm separates from the rocker cam, causing the valve to exceed a set lift, or in other words generating an irregular valve motion.

The irregular valve motion is suppressed by increasing the spring force of the valve spring. However, when a spring reaction force is increased, friction increases in the valve operating system, and as a result, fuel consumption increases.

It is therefore an object of this invention to provide a valve operating device for an internal combustion engine which is capable of suppressing an irregular valve motion regardless of a rocking acceleration of a rocker cam.

To achieve the object described above, this invention provides a valve operating device that opens and closes a valve of an internal combustion engine by driving a valve stem in an axial direction, comprising a rocker cam that rocks in accordance with a rotation of a drive shaft which is synchronized with a rotation of the internal combustion engine, the rocker cam including a driving cam portion and a lift restricting cam portion, a cam follower that lifts the valve by contacting the driving cam portion slidingly so as to convert a rocking of the rocker cam into an axial direction motion of the valve stem, and a restricting member that is formed integrally with the cam follower on a rocker arm and prevents the cam follower from separating from the driving cam portion in cooperation with the lift restricting cam portion.

The details as well as other features and advantages of this invention are set forth in the remainder of the specification and are shown in the accompanying drawings.

DESCRIPTION OF THE PREFERRED EMBODIMENTS

Figure 1:
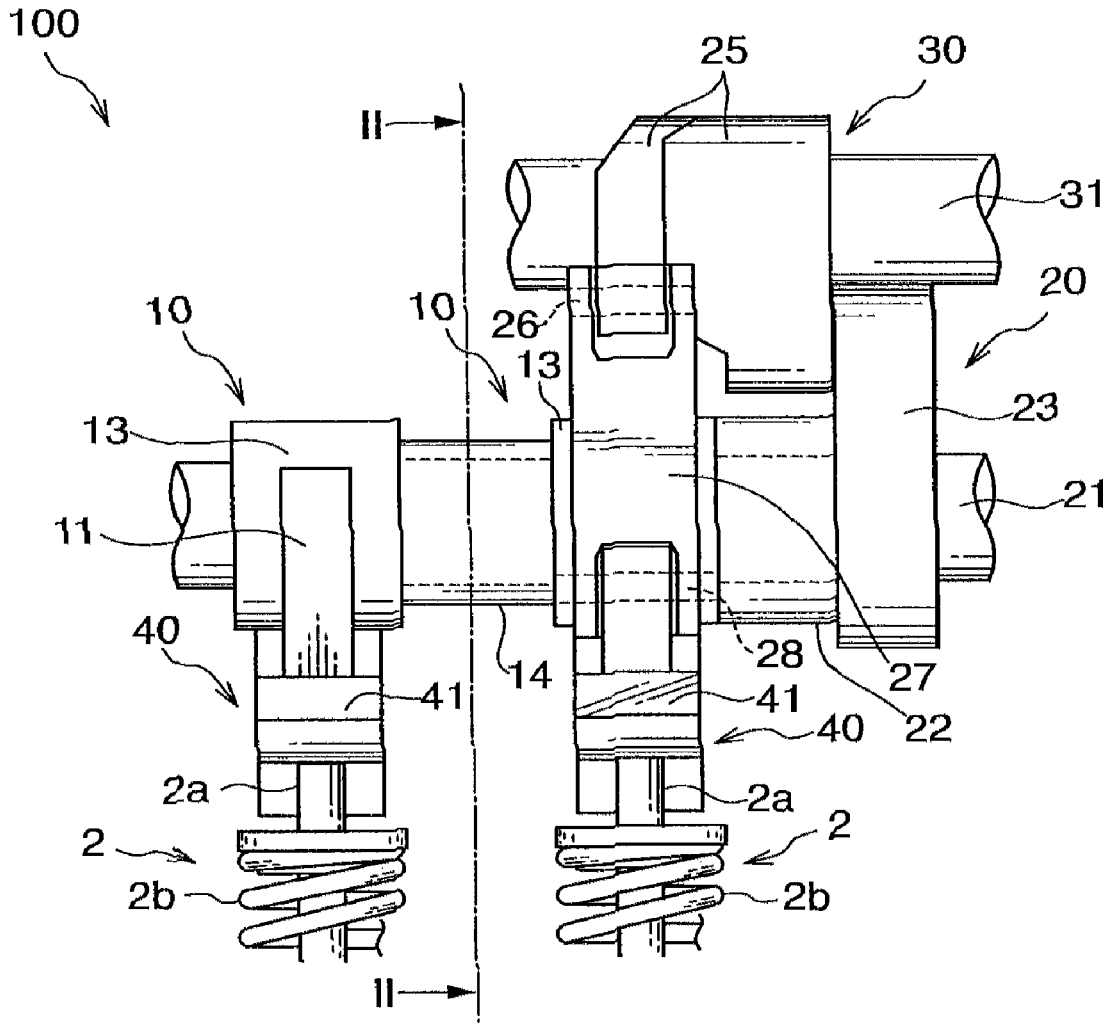
FIG. 1 is a front view of a valve operating device according to this invention.

Referring to FIG. 1 of the drawings, a variable valve device 100 is a device for opening and closing a valve 2 provided in a port, not shown in the figures, of an internal combustion engine for a vehicle or the like. The variable valve device 100 comprises a rocker arm 40 that contacts a valve stem of the valve 2, a rocker cam 10 that rocks the rocker arm 40, a rocker cam driving mechanism 20 that rocks the rocker cam 10, and a variable lift mechanism 30 that varies a lift of the valve 2. The valve 2 may be either an intake valve or an exhaust valve.

The internal combustion engine is a multi-cylinder internal combustion engine having two valves 2 per cylinder. FIG. 1 shows a valve driving mechanism of the variable valve device 100 for one cylinder. For each cylinder, two rocker arms 40 are driven respectively by two rocker cams 10. The two rocker cams 10 are integrated by a connecting tube 14 that is fitted onto an outer periphery of a drive shaft 21 to be free to rotate, and rock at an identical phase. Accordingly, the rocker cam driving mechanism 20 rocks the two rocker cams 10 by driving only one of the rocker cams 10.

A rotation of the internal combustion engine is transmitted to the drive shaft 21. The rocker cam 10 rocks the rocker arm 40, which is supported on a pivot pin 3 to be free to rock, by means of the following structure.

Figure 2:
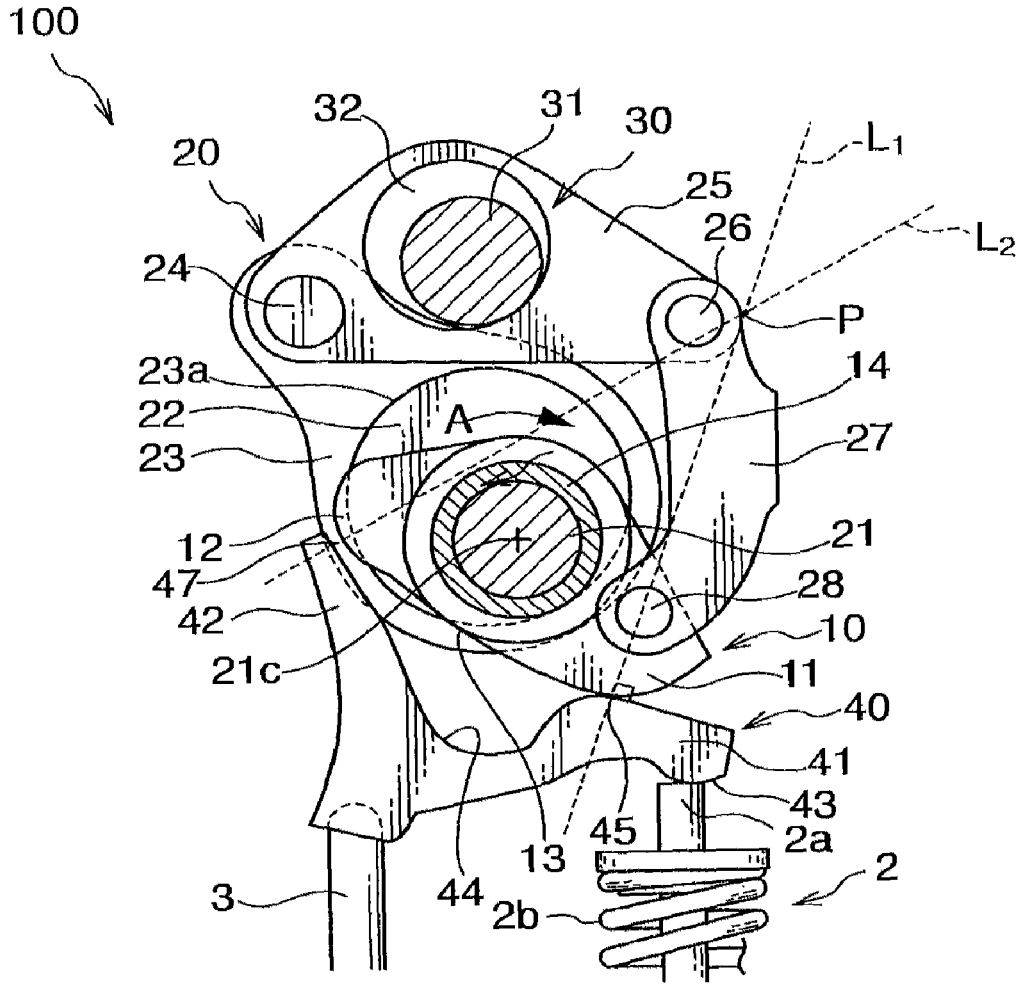
FIG. 2 is a longitudinal sectional view of the valve operating device, taken along a II-II line in FIG. 1.

Referring to FIG. 2, an outline of the rocker cam driving mechanism 20 will be described.

When the drive shaft 21 rotates in synchronization with the internal combustion engine, an eccentric cam 22 formed integrally with the drive shaft 21 rotates eccentrically. As a result, a first link 23 fitted onto an outer periphery of the eccentric cam 22 to be free to rotate performs a vertical reciprocating motion. A connecting arm 25, one end of which is connected to the first link 23 via a connecting pin 24, is fitted onto an outer periphery of an eccentric cam portion 32, which is formed integrally with a control shaft 31, to be free to rotate relative thereto. When the first link 23 reciprocates vertically, the connecting arm 25 rocks about the eccentric cam portion 32 in accordance with the reciprocating motion, and as a result, a second link 27 connected to another end of the connecting arm 25 via a connecting pin 26 performs a vertical reciprocating motion. The rocker cam 10 is connected to the second link 27 via a connecting pin 28. In this link system, when the drive shaft 21 rotates, the rocker cam 10 fitted onto the outer periphery of the drive shaft 21 rocks about the drive shaft 21 within a predetermined rotation angle range, and as a result, the rocker arm 40 rocks using the pivot pin 3 as a fulcrum.

The variable lift mechanism 30 controls a rotation angle phase of the rocker cam 10 in the above-described rocking mechanism of the rocker arm. The control shaft 31 forms a part of the variable lift mechanism 30, and is connected to an actuator, not shown in the figures, via a gear or the like. When the actuator varies the rotation position of the control shaft 31, a center of the eccentric cam portion 32 serving as a rocking center of the connecting arm 25 displaces rotationally about the control shaft 31, and accordingly, a fulcrum position of the connecting arm 25 varies. As a result, an angle formed by the first link 23 and the second link 27 varies. Further, a distance between a center 21*c* of the drive shaft 21 and the rocking center of the connecting arm 25 varies. In other words, a rocking characteristic of the rocker cam 10 varies. Hence, by varying the rotation position of the control shaft 31 in accordance with an operating condition using the actuator, a lift operating angle and a lift amount of the valve 2 can be varied continuously.

The rocker cam 10 comprises a driving cam portion 11 that contacts the rocker arm 40, and a lift restricting cam portion 12 that prevents irregular motion in the rocker arm 40. In other words, the driving cam portion 11 and the lift restricting cam portion 12 is formed integrally in the rocker cam 10. The driving cam portion 11 and the lift restricting cam portion 12 are formed on an identical plane so as to overlap when the drive shaft 21 is viewed from a right angle direction.

The driving cam portion 11 has a cam profile that is suited to a preferable valve lift characteristic of the valve 2. The driving cam portion 11 is positioned closer to a center line of the valve stem than the center 21*c* of the drive shaft 21, which serves as the rocking center of the rocker cam 10, even when the valve 2 is not lifted. The lift restricting cam portion 12 is provided on the opposite side of the center 21*c* of the drive shaft 21 to the driving cam portion 11. A base portion 13 that performs valve clearance management and the like is provided in the rocker cam 10 between the driving cam portion 11 and the lift restricting cam portion 12. The rocker cam driving mechanism 20 causes the rocker cam 10 to rock in conjunction with a crankshaft, not shown in the figures, of the internal combustion engine using the drive shaft 21 as a fulcrum, whereby the valve 2 is opened and closed via the rocker arm 40. When the driving cam portion 11 is rocked in a direction for pushing down the valve stem of the valve 2 via the rocker arm 40, or in other words a direction indicated by an arrow A in FIG. 2, the valve 2 is opened. FIG. 2 corresponds to a state in which the valve 2 is open.

The rocker arm 40 comprises a cam follower 41 having a surface that slides over the driving cam portion 11 of the rocker cam 10, and a restricting member 42 that is capable of contacting the lift restricting cam portion 12 of the rocker cam 10. An end portion 43 of the cam follower 41 contacts a stem end 2*a* of the valve stem of the valve 2. The restricting member 42 bends from a base end of the cam follower 41 toward the lift restricting cam portion 12. In other words, the cam follower 41 and the restricting member 42 substantially form an L shape. A central portion of the rocker arm 40, or more specifically a boundary portion between the cam follower 41 and the restricting member 42, is supported by the pivot pin 3. The rocker arm 40 rocks in a clockwise direction and a counter-clockwise direction of the figure using the pivot pin 3 as a fulcrum in accordance with the rocking of the rocker cam 10. The pivot pin 3 is provided in an offset position from the center line of the valve stem of the valve 2. A lash adjuster may be used instead of the pivot pin 3. The rocker arm 40 includes a recessed portion 44 provided between a sliding contact portion 45 of the cam follower 41, which slidingly contacts the driving cam portion 11, and the restricting member 42 so that when the rocker cam 10 rocks, the rocker arm 40 does not interfere with the lift restricting cam portion 12.

The shape and dimensions of the restricting member 42 and the lift restricting cam portion 12 are set such that during a normal operation of the variable valve device 100, a predetermined small gap is always maintained between these members. The predetermined small gap is defined as a minimum gap at which the lift restricting cam portion 12 and the restricting member 42 do not interfere with each other at a rocking angle of the rocker arm 40 defined by the rocking angle of the rocker cam 10, and when the rocker arm 40 exceeds this rocking angle, the lift restricting cam portion 12 contacts the restricting member 42 such that the rocker arm 40 cannot rock any further. By ensuring that the predetermined small gap is always maintained between the restricting member 42 and the lift restricting cam portion 12, the restricting member 42 prevents the rocker arm 40 from rocking at or beyond a rocking angle corresponding to the small gap, regardless of the rocking angle of the rocker cam 10, in cases where the rocker arm 40 is about to jump out from the driving cam portion 11. The predetermined small gap is set between 0.1 and 0.3 millimeters, for example.

By causing the stem end 2*a* of the valve stem to contact the end portion 43 of the rocker arm 40, the valve 2 opens and closes an intake port or an exhaust port of the internal combustion engine in accordance with the rocking of the rocker arm 40. The valve stem of the valve 2 is normally biased in a closing direction by a valve spring 2*b*. A spring force of the valve spring 2*b* serves to keep the stem end 2*a* in contact with the rocker arm 40 and keep the rocker arm 40 in contact with the rocker cam 10.

Here, an intersection between a normal L1 of the cam follower 41 on the sliding contact portion 45 between the driving cam portion 11 and the cam follower 41 and a normal L2 of the restricting member 42 on a contact portion 47 formed when the restricting member 42 contacts the lift restricting cam portion 12 is set as P. The shape of the rocker arm 40 is set such that the intersection P is positioned on the opposite side of the center 21*c* of the drive shaft 21 to the pivot pin 3.

In the variable valve device 100 described above, as shown in FIGS. 1 and 2, the rocker cam 10 is fitted onto the outer periphery of the drive shaft 21 to be free to rotate, and rocks via the rocker cam driving mechanism 20 in conjunction with the crankshaft. The drive shaft 21 is disposed parallel to a cylinder arrangement direction so as to penetrate the rocker cam 10. Two valves 2 are provided for each cylinder, and therefore a pair of rocker cams 10 and a pair of rocker arms 40 are provided for each cylinder. To ensure that the pair of rocker cams 10 and the pair of rocker arms 40 operate synchronously and uniformly, the pair of rocker cams 10 are joined at an identical phase to the connecting tube 14 that is fitted onto the drive shaft 21 to be free to rotate. The rocker cam driving mechanism 20 drives only one of the rocker cams 10, as noted above.

The eccentric cam 22 is fixed to the drive shaft 21 using a method such as press fitting. The eccentric cam 22 has a circular outer peripheral form, and a center thereof is offset from the center 21*c* of the drive shaft 21 by a predetermined amount. The drive shaft 21 rotates in conjunction with the rotation of the crankshaft, and in accordance therewith, the eccentric cam 22 rotates eccentrically about the center line 21*c* of the drive shaft 21.

A base end ring-shaped portion 23*a* of the first link 23 is fitted to an outer peripheral surface of the eccentric cam 22 to be free to rotate. As described above, a tip end of the first link 23 is connected to one end of the connecting arm 25 via the connecting pin 24. Further, the other end of the connecting arm 25 is connected to an upper end of the second link 27 via the connecting pin 26. A lower end of the second link 27 is connected to the driving cam portion 11 of the rocker cam 10 via the connecting pin 28. The connecting pin 28 is positioned closer to the center line of the valve stem of the valve 2 than the center 21*c* of the drive shaft 21. A substantially central portion of the connecting arm 25 is fitted to an outer periphery of the eccentric cam portion 32 of the control shaft 31 of the variable lift mechanism 30 to be free to rock.

Next, an action of the variable valve device 100 will be described.

Figures 3A, 3B, 3C, 3D:
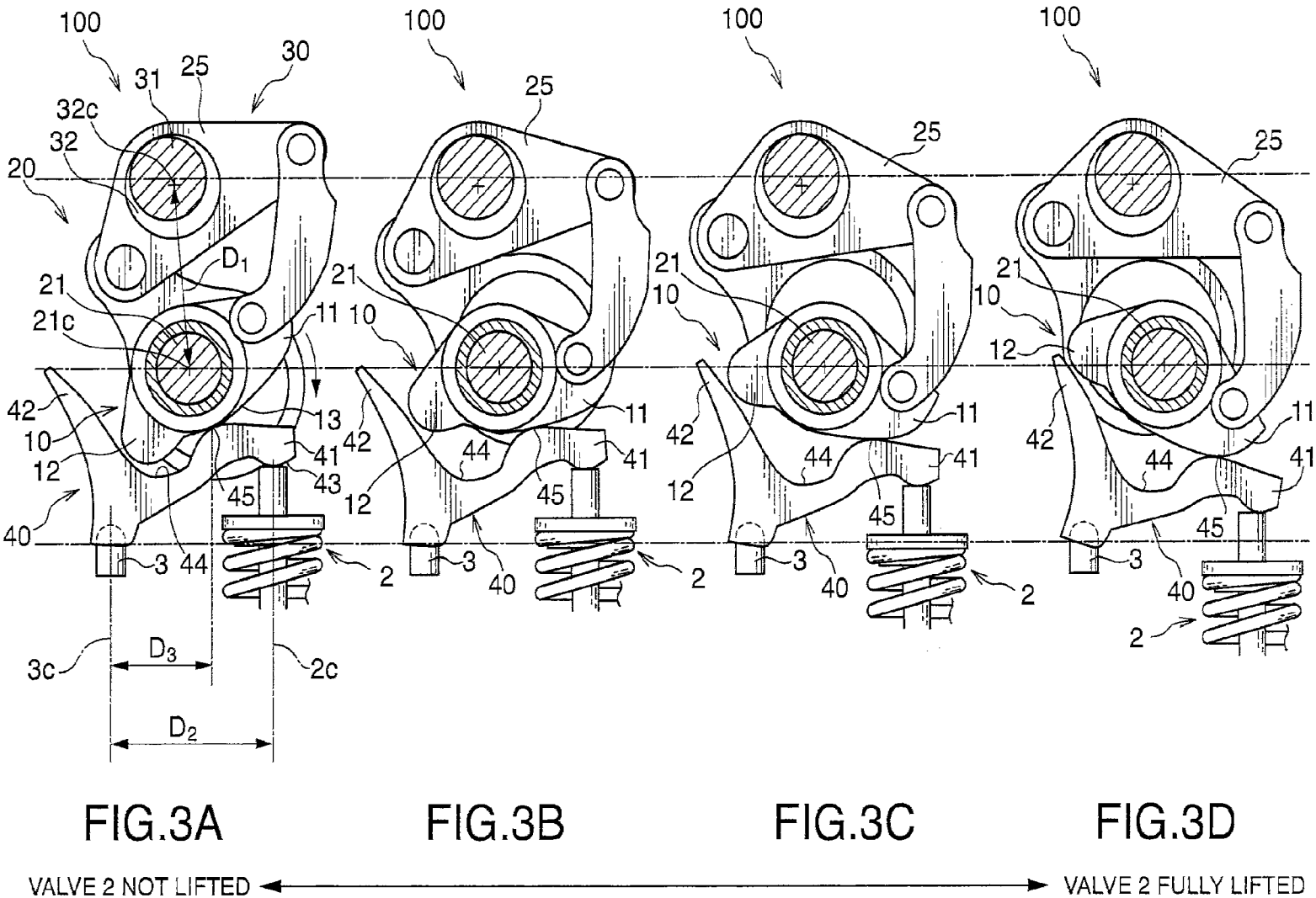
FIGS. 3A-3D are longitudinal sectional views of the valve operating device, illustrating a relationship between rocking of a rocker cam and a valve lift according to this invention.

FIGS. 3A-3D show the lift of the valve 2 generated by the rocking of the rocker cam 10 when a distance al between the rocking center 32*c* of the connecting arm 25 and the center 21*c* of the drive shaft 21 is at a minimum and the lift and operating angle of the valve 2 are at a maximum. FIG. 3A shows a state in which the valve 2 is not lifted. FIG. 3D shows a state in which the valve 2 is fully lifted.

The rocker cam 10 is driven by the rocker cam driving mechanism 20 to rock about the center 21*c* of the drive shaft 21. The center 21*c* is positioned between the center line 2*c* of the valve stem of the valve 2 and a center line 3*c* of the pivot pin 3.

When the valve 2 is not lifted such that the port is closed, as shown in FIG. 3A, the base portion 13 of the rocker cam 10 contacts the cam follower 41 of the rocker arm 40. In this state, the recessed portion 44 formed between the cam follower 41 and the restricting member 42 prevents interference between the lift restricting cam portion 12 and the part of the rocker arm 40 located between the cam follower 41 and the restricting member 42.

As shown in FIGS. 3B-3D, the rocker cam 10 moves a contact point with the cam follower 41 from the base portion 13 toward the driving cam portion 11. This process will be referred to as an outward motion. As a result of this outward motion, the driving cam portion 11 gradually pushes the cam follower 41 of the rocker arm 40. The rocker arm 40 rocks in the clockwise direction of the figure using the pivot pin 3 as a fulcrum, thereby pushing down the valve stem contacting the end portion 43 of the rocker arm 40. As a result, the valve 2 lifts such that the port, not shown in the figures, is opened. The valve spring 2*b* that biases the valve stem of the valve 2 in the closing direction is compressed in accordance with the valve lift. When the valve 2 is not lifted, i.e. in the state shown in FIG. 3A, the lift restricting cam portion 12 of the rocker cam 10 is positioned within the recessed portion 44, but when the rocker cam 10 reciprocates, the lift restricting cam portion 12 shifts in the direction of a tip end of the restricting member 42. It should be noted that the shape of the recessed portion 44 of the rocker arm 40 is set in advance to ensure that even when a position in which the lift restricting cam portion 12 faces the rocker arm 40 shifts in the tip end direction of the restricting member 42, the lift restricting cam portion 12 and the restricting member 42 do not come into contact. Conversely, a process in which the sliding contact portion 45 between the rocker cam 10 and the cam follower 41 is moved in the direction of the base portion 13 from the driving cam portion 11 will be referred to as a returning motion.

In a section extending from the state shown in FIG. 3A, in which the valve 2 is not lifted, to the state shown in FIG. 3C, in which a positive acceleration of the rocker cam 10 is in the vicinity of a maximum value, the driving cam portion 11 and the sliding contact portion 45 of the rocker arm 40 approach the valve stem such that the valve 2 is lifted. In the state shown in FIG. 3C, in which the positive acceleration of the rocker cam 10 is in the vicinity of the maximum value, a maximum load acts on the rocker arm 40. Likewise in the return section, the acceleration of the rocker cam 10 in a valve stem driving direction approaches a maximum value in a position corresponding to FIG. 3C. With respect to the sign of the acceleration, acceleration oriented such that the rocker cam 10 pushes down the valve stem will be referred to as positive acceleration.

When a distance between the valve 2 and the pivot pin 3 is represented by D2 and a distance between the sliding contact portion 45 and the pivot pin 3 is represented by D3, a rocker ratio D2/D3 is smaller in the state shown in FIG. 3C, in which the positive acceleration of the rocker cam 10 is in the vicinity of the maximum value, than in the other lift states.

After the valve 2 reaches the fully lifted state shown in FIG. 3D, the rocker cam 10 rocks in an opposite direction such that the contact point with the cam follower 41 moves from the driving cam portion 11 toward the base portion 13. In other words, the rocking of the rocker cam 10 shifts from the outward motion to the returning motion. As a result of the returning motion, the position in which the lift restricting cam portion 12 faces the rocker arm 40 moves from the tip end of the restricting member 42 toward the recessed portion 44. As a result of the returning motion, the pressing force applied to the cam follower 41 by the driving cam portion 11 weakens, and therefore the valve stem of the valve 2 is pushed up by the spring force of the valve spring 2*b* such that the valve 2 closes the port. The rocker arm 40 is held against the rocker cam 10 by the spring force of the valve spring 2*b*.

A cam shape of the rocker cam 10 is set in advance to reduce a rocking speed so that the orientation of the rocker cam 10 is switched from the outward motion to the returning motion within a section of a predetermined rocking angle range extending to the fully lifted state of the valve 2. In a predetermined rocking angle section following the fully lifted state of the valve 2, the force with which the rocker cam 10 pushes the valve stem via the rocker arm 40 decreases. Even when the pushing force applied to the rocker arm 40 by the rocker cam 10 decreases, the rocker arm 40 may continue to displace in the opening direction of the valve 2 due to an inertial force acting on the rocker arm 40 such that the rocker arm 40 is separated from the rocker cam 10. This separation leads to the above-described irregular motion in the rocker arm 40.

The section in which the rocker arm 40 is most likely to separate from the rocker cam 10 is the section in which acceleration of the rocker cam 10 in the valve stem driving direction becomes negative according to the definitions of positive and negative acceleration described above. The acceleration of the rocker cam 10 in the valve stem driving direction reaches a maximum in the rocking position shown in FIG. 3C, then decreases rapidly so as to turn negative, and then, after passing the fully lifted position shown in FIG. 3D, shifts to a positive value on the way back to the rocking position shown in FIG. 3C. In this section, or more specifically in a section that centers on the fully lifted position of the valve 2 and extends from a rocking position in which the acceleration of the rocker cam 10 in the valve stem driving direction reaches a maximum value during the outward motion to a rocking position in which the acceleration of the rocker cam 10 in the valve stem driving direction reaches a maximum value during the returning motion, it is important to prevent the rocker arm 40 from separating from the rocker cam 10 in order to prevent irregular motion in the rocker arm 40.

Figure 4:
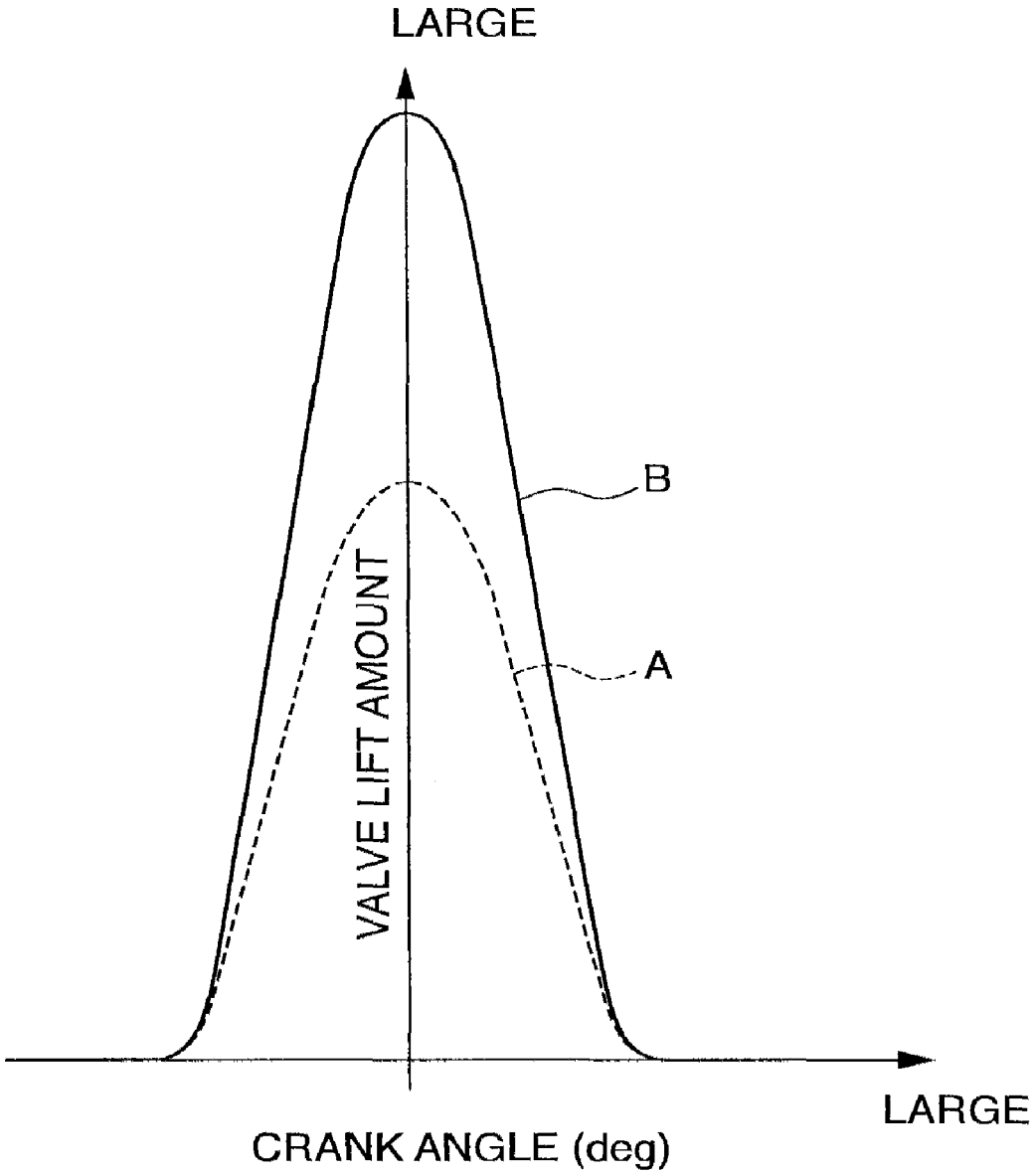
FIG. 4 is a diagram showing a valve lift generated by the valve operating device.

Referring to FIG. 4, the lift of the valve 2 will be described. The abscissa of the figure shows a crank angle, and the ordinate shows the valve lift amount.

When the load of the internal combustion engine shifts from a low load to a high load, the variable lift mechanism 30 increases the valve lift of the valve 2 from a broken line A to a solid line B in FIG. 4 to increase a charging efficiency of the internal combustion engine and thereby achieve an improvement in output. Here, when only the valve lift is increased within a constant crank angle range, the rocking acceleration of the rocker cam 10 increases, causing the incline of the valve lift curve to sharpen. This variation causes the inertial force acting on the rocker arm 40 to increase after the direct driving force of the rocker cam 10 has stopped acting on the rocker arm 40. Moreover, at a valve lift peak, negative acceleration acting on the rocker cam 10, or in other words a lift reduction rate, also increases. All of these factors encourage the rocker arm 40 to separate from the rocker cam 10 against the spring force. When the rocker arm 40 separates from the rocker cam 10, the lift of the valve 2 increases beyond the set full lift, generating a so-called irregular valve motion.

By suppressing the valve lift, the irregular valve motion can be suppressed. However, when the valve lift is suppressed, it becomes impossible to achieve an improvement in output by raising the charging efficiency of the internal combustion engine.

This invention solves this problem by providing the lift restricting cam portion 12 in the rocker cam 10 and providing the restricting member 42 in the rocker arm 40.

More specifically, when the valve 2 is in the fully lifted state shown in FIG. 3D and the rocking acceleration of the rocker cam 10 increases such that an inertial force which is greater than the spring force acts on the rocker arm 40, the rocker arm 40 attempts to displace in a direction for lifting the valve 2 even further. When the rocker arm 40 thus attempts to separate from the rocker cam 10, the restricting member 42 of the rocker arm 40 contacts the lift restricting cam portion 12 of the rocker cam 10, thereby preventing the rocker arm 40 from separating from the rocker cam 10.

In the section extending from FIG. 3A to FIG. 3C also, the lift restricting cam portion 12 and the restricting member 42 oppose each other via the predetermined small gap. The restricting member 42 contacts the lift restricting cam portion 12 similarly when the cam follower 41 of the rocker arm 40 attempts to separate from the driving cam portion 11 in this section, and therefore the cam follower 41 is substantially prevented from separating from the driving cam portion 11.

The shape of the recessed portion 44 may also be set such that the lift restricting cam portion 12 and the restricting member 42 oppose each other via the predetermined small gap only in the vicinity of the fully lifted state shown in FIG. 3D and oppose each other via a larger gap than the predetermined small gap in the other sections. In this case, the gap between the lift restricting cam portion 12 and the restricting member 42 is set to be large in the states shown in FIGS. 3A to 3C, and therefore the dimensions of the lift restricting cam portion 12 can be reduced.

According to the variable valve device 100 described above, the rocker arm 40 is prevented from separating from the rocker cam 10 due to inertial force by bringing the restricting member 42 into contact with the lift restricting cam portion 12. Hence, irregular motion can be prevented in the rocker arm 40. By preventing irregular motion in the rocker arm 40, the following effects are obtained.

Even when the rocker arm 40 is prevented from separating from the driving cam portion 11, the valve stem may be separated from the rocker arm 40 by an inertial force acting on the valve 2. The inertial force in this case is based on the weight of the valve 2 including the valve stem. Meanwhile, when separation of the rocker arm 40 from the driving cam portion 11 is not restricted, an inertial force based on the total weight of the rocker arm 40 and the valve 2 acts on the valve 2.

Hence, by restricting separation of the rocker arm 40 from the driving cam portion 11, the inertial force acting on the valve 2 in the lift direction is greatly reduced. Accordingly, the spring force of the valve spring 2*b* required to prevent irregular motion in the valve 2 also decreases greatly. As a result, a favorable effect in terms of preventing irregular motion in the valve 2 is obtained.

Further, irregular motion in the valve 2 caused by inertial force is dependent on the rotation speed of the internal combustion engine. Therefore, assuming that the specifications of the employed valve spring 2*b* are fixed, the rotation speed of the internal combustion engine at which irregular motion begins in the valve 2 is further toward a high rotation speed side when separation of the rocker arm 40 from the driving cam portion 11 is restricted than when separation of the rocker arm 40 from the driving cam portion 11 is not restricted. Hence, even when the lift of the valve 2 is increased in accordance with an increase in the load of the internal combustion engine, irregular motion is unlikely to occur in the valve 2, and as a result, an improvement in the charging efficiency of the internal combustion engine can be achieved.

In the variable valve device 100, the valve 2 is biased in the closing direction by the valve spring 2*b*. Instead of the valve spring 2*b*, a link may be used to close the valve 2. However, when the valve spring 2*b* is used, a strong biasing force can be applied to the valve 2 in the closing direction, and therefore the ability of the valve 2 to cut away deposits that become attached between the valve 2 and a valve seat can be improved.

In the variable valve device 100, the driving cam portion 11 and the lift restricting cam portion 12 are formed in the rocking cam 10 integrally and on an identical plane. In other words, when the drive shaft 21 is seen from a right angle direction, the driving cam portion 11 and lift restricting cam portion 12 overlap. Thus, the required axial direction dimension of the rocker cam 10 can be reduced, enabling reductions in the weight and bulkiness of the rocker cam 10. As a result, the weight and inertial mass of the variable valve device 100 can be reduced, enabling reductions in a valve driving torque and stress in the respective constitutional members. Moreover, by making the rocker cam 10 compact, a layout freedom of the variable valve device 100 is improved.

In the variable valve device 100, the recessed portion 44 formed in the rocker arm 40 prevents contact between the lift restricting cam portion 12 and the rocker arm 40 as the rocker cam 10 rocks. Therefore, during a normal operation of the variable valve device 100, friction is not generated between the lift restricting cam portion 12 and the rocker arm 40. Furthermore, the lift restricting cam portion 12 and the restricting member 42 oppose each other via the predetermined small gap at all times, and therefore irregular motion is prevented in the rocker arm 40 regardless of the rocking angle of the rocker arm 40. Hence, the spring force of the valve spring 2*b* can be reduced. By reducing the spring force of the valve spring 2*b*, friction between the rocker cam 10 and rocker arm 40 is reduced, and therefore an improvement in the fuel efficiency of the internal combustion engine is achieved.

On the other hand, the lift restricting cam portion 12 and the restricting member 42 may oppose each other via the predetermined small gap only in the vicinity of the fully lifted position of the valve 2 and oppose each other via a larger gap than the predetermined small gap in other positions. In this case, irregular motion in the rocker arm 40 is prevented only in the vicinity of the fully lifted position of the valve 2, but since the dimensions of the lift restricting cam portion 12 can be reduced, further reductions in the size and weight of the variable valve device can be achieved.

The driving cam portion 11 of the rocker cam 10 is positioned closer to the center line of the valve stem of the valve 2 than the center 21*c* of the drive shaft 21. Therefore, in the vicinity of the maximum acceleration of the rocker cam 10, in which the load applied to the rocker arm 40 by the rocker cam 10 reaches a maximum, the rocker ratio of the rocker arm 40 decreases relative to the rocker ratio at other crank angles. As a result, an input load input into the rocker arm 10 in the vicinity of the maximum positive acceleration of the rocker cam 10 can be reduced, enabling a reduction in contact pressure generated between the rocker cam 10 and the rocker arm 40. When the contact pressure decreases, abrasion between the rocker arm 40 and the rocker cam 10 decreases, and therefore the freedom to select the material of the rocker cam 10 improves. By improving the material selection freedom, an improvement in workability and a reduction in cost can be achieved in relation to the rocker cam 10.

Referring to FIGS. 5-7, 8A-8D, and 9A-9D, a variable valve device 200 according to a second embodiment of this invention will be described.

Figure 5:
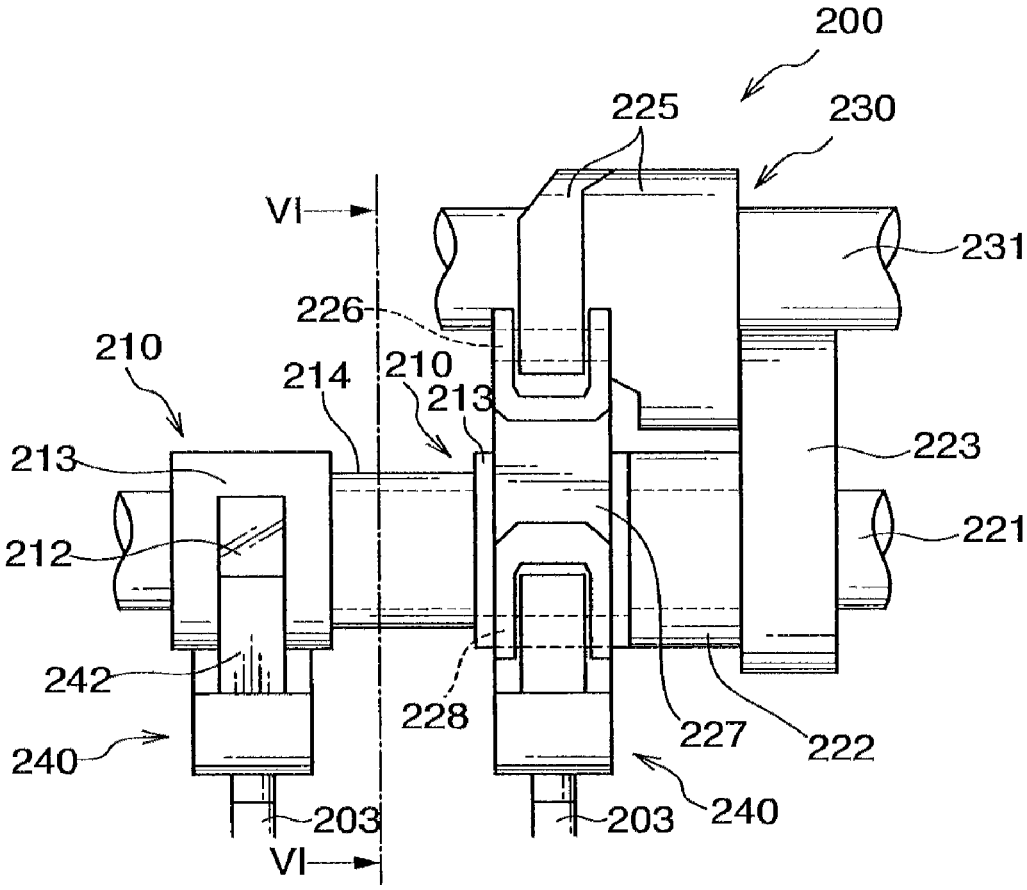
FIG. 5 is a front view of a valve operating device according to a second embodiment of this invention.

Referring to FIG. 5, the variable valve device 200 is a device for opening and closing a valve 202 provided in an intake port or an exhaust port of an internal combustion engine for a vehicle or the like. The variable valve device 200 comprises a rocker arm 240 that contacts the valve stem of the valve 202, a rocker cam 210 that rocks the rocker arm 240, a rocker cam driving mechanism 220 that rocks the rocker cam 210, and a variable lift mechanism 230 that varies the lift of the valve 202.

Figure 6:
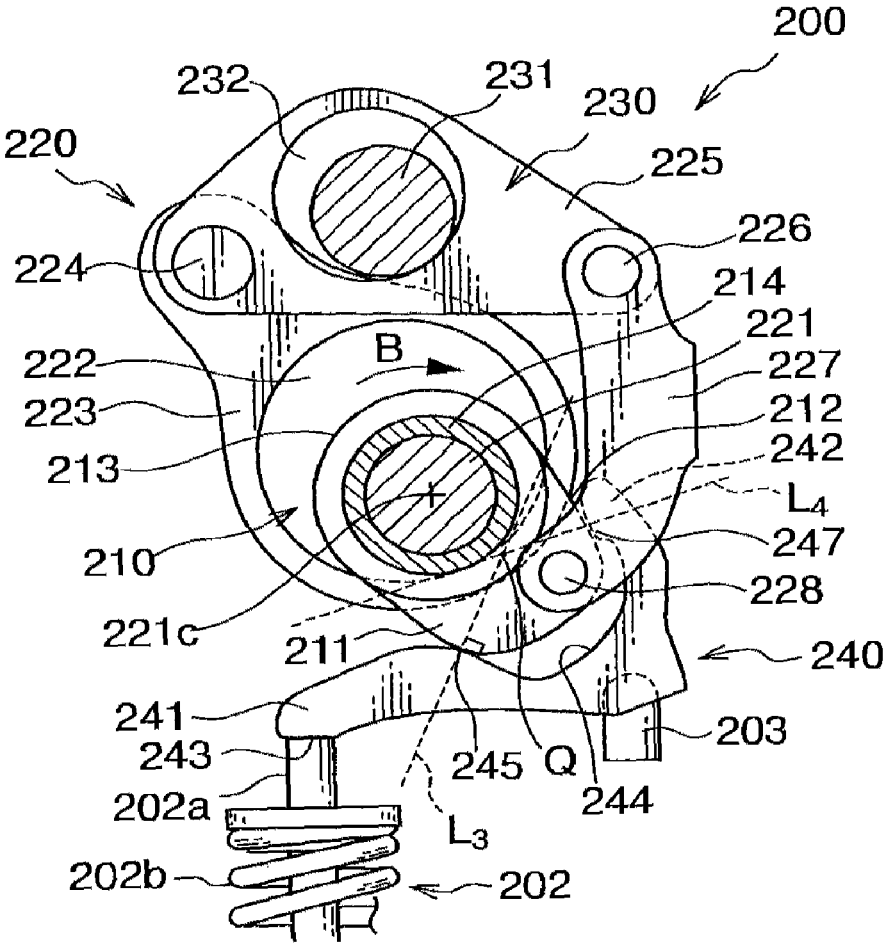
FIG. 6 is a longitudinal sectional view of the valve operating device according to the second embodiment of the invention, taken along a VI-VI line in FIG. 5.

Referring to FIG. 6, the rocker cam driving mechanism 220 and the variable lift mechanism 230 are constituted identically to the rocker cam driving mechanism 20 and variable lift mechanism 30 of the first embodiment. More specifically, a drive shaft 221, a center 221*c* of the drive shaft 221, a connecting tube 214, an eccentric cam 222, a first link 223, a ring-shaped portion 223*a*, a connecting pin 224, a connecting arm 225, a control shaft 231, a cam portion 232, a connecting pin 226, a second link 227, and a connecting pin 228 are constituted identically to the drive shaft 21, the center 21*c* of the drive shaft 21, the connecting tube 14, the eccentric cam 22, the first link 23, the ring-shaped portion 23*a*, the connecting pin 24, the connecting arm 25, the control shaft 31, the cam portion 32, the connecting pin 26, the second link 27, and the connecting pin 228 of the first embodiment, respectively.

In this embodiment, a horizontal direction positional relationship between the valve 202 and a pivot pin 203 is opposite to that of the first embodiment, and therefore a horizontal direction positional relationship between a cam follower 241 and a restricting member 242 of the rocker arm 240 is also opposite to the horizontal direction positional relationship between the cam follower 41 and restricting member 42 of the first embodiment. The shape of the rocker cam 210 also differs from that of the rocker cam 10 according to the first embodiment. A recessed portion 244 is formed between the cam follower 241 and the restricting member 242.

The rocker cam 210 has a cam surface constituted by an arc-shaped base portion 213 that shares the center 221*c* with the drive shaft 221, a driving cam portion 211 for pushing the rocker arm 240, and a lift restricting cam portion 212 for preventing irregular motion in the rocker arm 240. In other words, the driving cam portion 211 and the lift restricting cam portion 212 are formed integrally in the rocker cam 210. The driving cam portion 211 has a cam profile that is suited to a preferable valve lift characteristic of the valve 202. The driving cam portion 211 is positioned farther from the center line of the valve stem than the center 221*c* of the drive shaft 221. The driving cam portion 211 and lift restricting cam portion 212 are connected smoothly to form a shape that simply bulges outwardly without a recessed portion provided midway. The driving cam portion 211 and lift restricting cam portion 212 overlap when the drive shaft 221 is seen from a right angle direction.

The rocker cam driving mechanism 220 causes the rocker cam 210 to rock in conjunction with the crankshaft, not shown in the figures, using the drive shaft 221 as a fulcrum, whereby the valve 202 is opened and closed via the rocker arm 240. When the rocker cam 210 is rocked in a direction for pushing down the valve stem of the valve 202 via the rocker arm 240, or in other words a direction indicated by an arrow B in the figure, the valve 202 is opened. FIG. 6 corresponds to a state in which the valve 202 is open.

The rocker arm 240 is formed similarly to the rocker arm 40 of the first embodiment. The restricting member 242 and the lift restricting cam portion 212 are shaped such that during a normal operation, a similar predetermined small gap to that of the first embodiment is maintained between these members at all times. By maintaining the predetermined small gap between the restricting member 242 and the lift restricting cam portion 212 at all times, the restricting member 242 prevents the rocker arm 240 from rocking at or beyond a rocking angle corresponding to the small gap, regardless of the rocking angle of the rocker cam 210, in cases where the cam follower 241 is about to jump out from the driving cam portion 211.

By causing a stem end 202*a* of the valve stem to contact an end portion 243 of the rocker arm 240, the valve 202 opens and closes the intake port or exhaust port of the internal combustion engine in accordance with the rocking of the rocker arm 240. The valve stem of the valve 202 is normally biased in the closing direction by a valve spring 202*b*. A spring force of the valve spring 202*b* serves to keep the stem end 202*a* in contact with the rocker arm 240 and keep the rocker arm 240 in contact with the rocker cam 210.

Here, an intersection between a normal L3 of the cam follower 241 on a sliding contact portion 245 in which the driving cam portion 211 and the cam follower 241 contact each other slidingly and a normal L4 of the restricting member 242 on a contact portion 247 formed when the restricting member 242 contacts the lift restricting cam portion 212 is set as Q. The shape of the rocker arm 240 is set such that the intersection Q and the pivot pin 203 are positioned on the same side of the center 221*c* of the drive shaft 221.

In the variable valve device 200 described above, as shown in FIGS. 5 and 6, the rocker cam 210 is fitted onto the outer periphery of the drive shaft 221 to be free to rotate, and rocks via the rocker cam driving mechanism 220 in conjunction with the crankshaft.

In this embodiment, the connecting pin 228 connecting the second link 227 to the rocker cam 210 is latched to the lift restricting cam portion 212 and positioned closer to the center line of the pivot pin 203 than the center 221*c* of the drive shaft 221.

Figure 7:
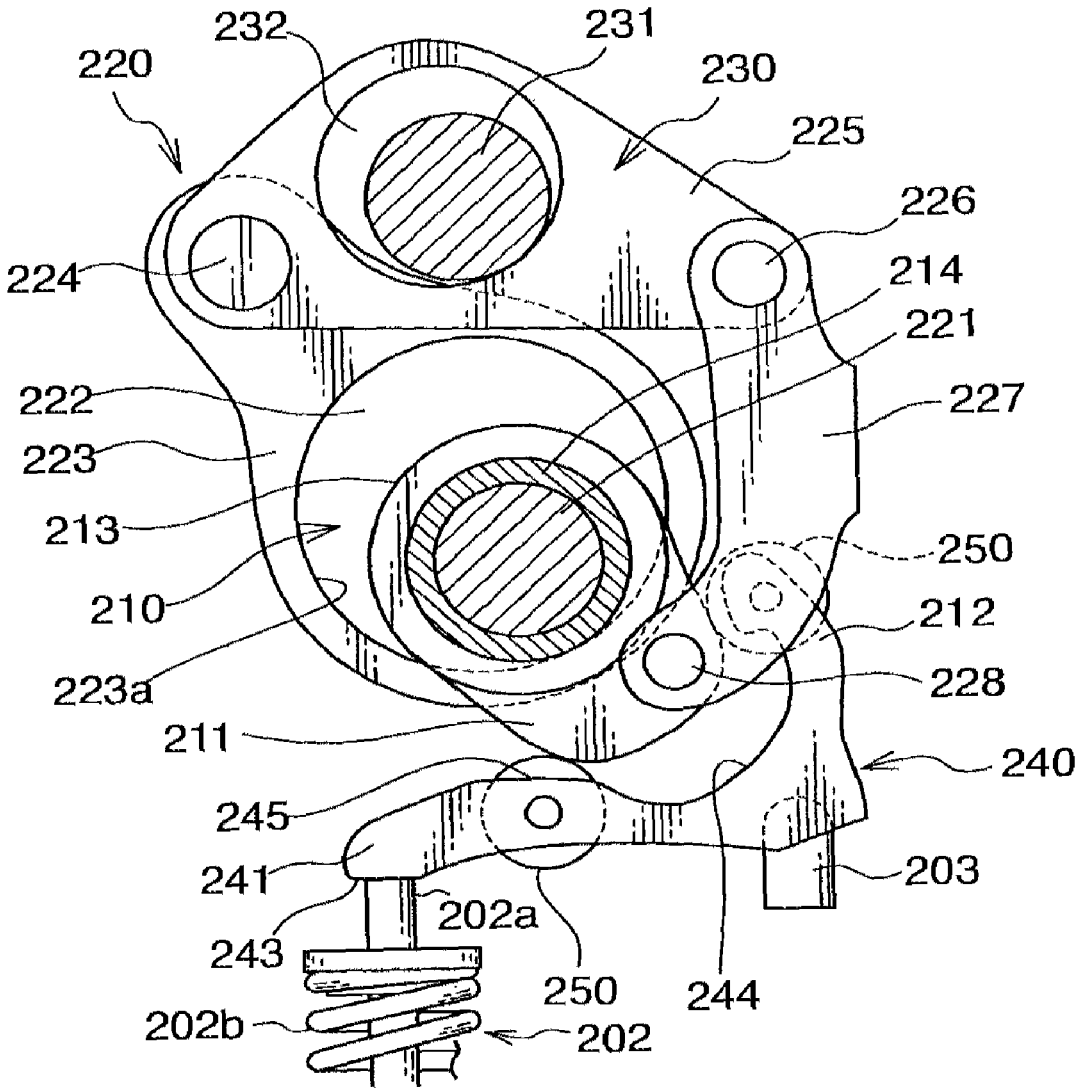
FIG. 7 is a longitudinal sectional view of the valve operating device, illustrating a variation of the second embodiment of the invention.

Referring to FIG. 7, a variation of the second embodiment will be described. Here, rollers 250 are provided on the two sliding contact portions between the rocker arm 240 and the rocker cam 210. In other words, the sliding contact portion 245 between the driving cam portion 211 and the cam follower 241 and the contact portion 247 between the lift restricting cam portion 212 and the restricting member 242 are each provided with the roller 250. This design is preferable in terms of reducing friction between the rocker cam 210 and the rocker arm 240.

Next, actions of the variable valve device 200 will be described.

Figures 8A, 8B, 8C, 8D:
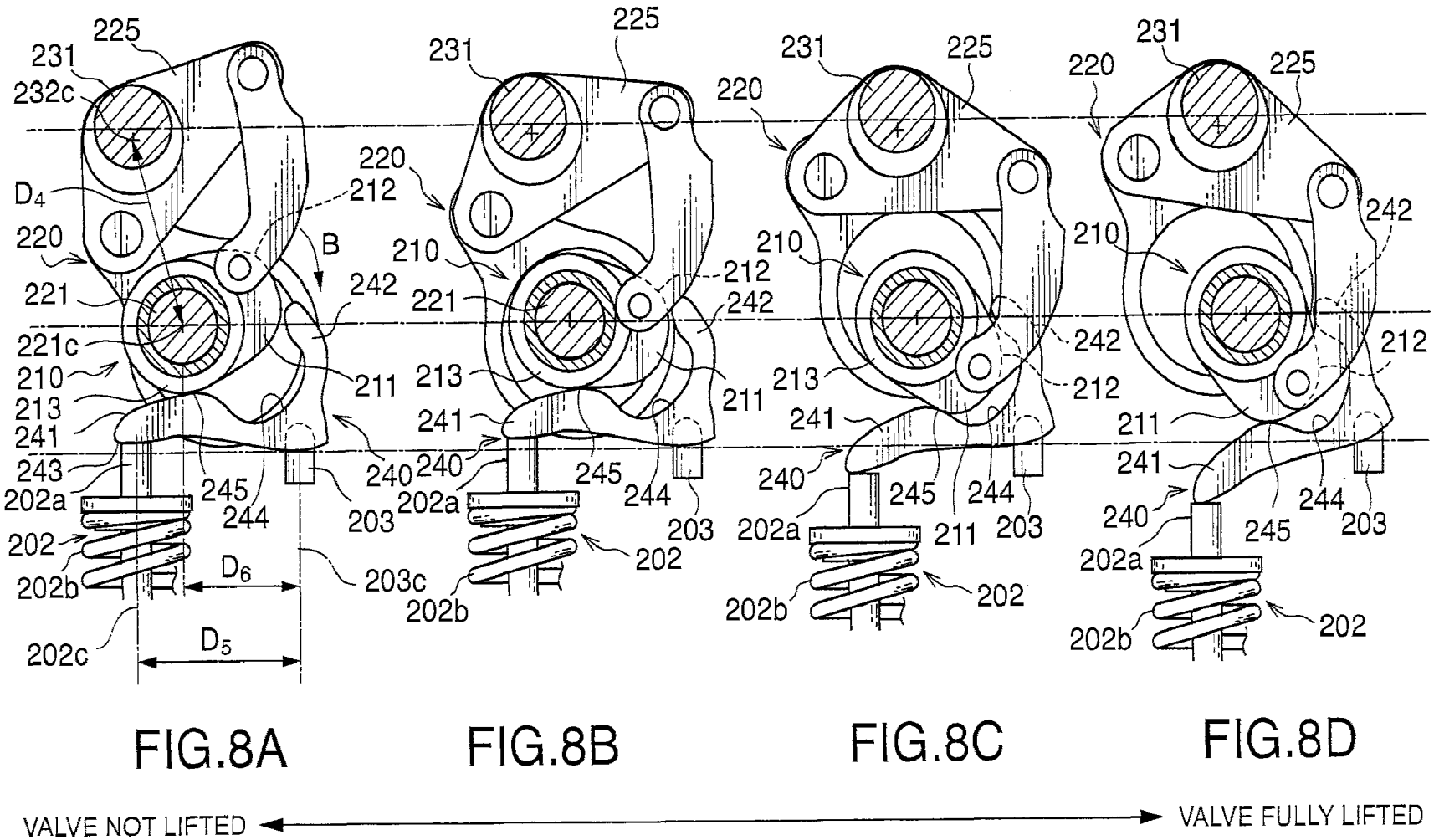
FIGS. 8A-8D are longitudinal sectional views illustrating a relationship between the rocking of the rocker cam at a maximum operating angle and the valve lift in the valve operating device according to the second embodiment of the invention.

FIGS. 8A-8D show the lift of the valve 202 generated by the rocking of the rocker cam 210 when a distance between a rocking center 232*c* of the connecting arm 225 and the center 221*c* of the drive shaft 221 is set at a minimum distance D4 such that the valve 202 is at a maximum lift and a maximum operating angle. FIG. 8A shows a state in which the valve 202 is not lifted. FIG. 8D shows a state in which the valve 202 is fully lifted.

The rocker cam driving mechanism 220 causes the rocker cam 210 to rock in conjunction with the crankshaft using the drive shaft 221 as a fulcrum, whereby the valve 202 is opened and closed via the rocker arm 240. A rocking center of the rocker cam 210 is positioned between a center line 202*c* of the valve 202 and a center line 203*c* of the pivot pin 203.

When the valve 202 is not lifted and the port is closed, as shown in FIG. 8A, the base portion 213 of the rocker cam 210 contacts the cam follower 241 of the rocker arm 240.

As shown in FIGS. 8B-8D, the contact point between the rocker cam 210 and the cam follower 241 moves from the base portion 213 toward the driving cam portion 211. This process will be referred to as an outward motion. As a result of this outward motion, the driving cam portion 211 gradually pushes the cam follower 241 of the rocker arm 240. The rocker arm 240 rocks in the counter-clockwise direction of the figure using the pivot pin 203 as a fulcrum, thereby pushing down the valve stem contacting the end portion 243 of the rocker arm 240. As a result, the valve 202 lifts such that the port, not shown in the figures, is opened. The valve spring 202*b* that biases the valve stem of the valve 202 in the closing direction is compressed in accordance with the valve lift.

In this embodiment, the driving cam portion 211 and the sliding contact portion 245 of the rocker arm 240 lift the valve 202 while approaching the pivot pin 203 in a section extending from the state shown in FIG. 8A, in which the valve 202 is not lifted, to the state shown in FIG. 8C, in which the acceleration of the rocker cam 210 is in the vicinity of a maximum value. When a distance between the valve stem of the valve 202 and the pivot pin 203 is represented by D5 and a distance between the sliding contact portion 245 and the pivot pin 203 is represented by D6, a rocker ratio D5/D6 is larger in the state shown in FIG. 8C, in which the acceleration of the rocker cam 210 is in the vicinity of the maximum value, than in the other lift states.

After the valve 202 has been fully lifted, the rocker cam 210 rocks in the opposite direction such that the contact point with the cam follower 241 moves from the driving cam portion 211 toward the base portion 213. This process will be referred to as a returning motion. As a result of the returning motion, the pressing force applied to the cam follower 241 by the driving cam portion 211 weakens, and therefore the valve 202 is pushed up by the spring force of the valve spring 202*b* such that the valve 202 closes the port. The rocker arm 240 is held against the rocker cam 210 by the spring force of the valve spring 202*b*.

The cam shape of the rocker cam 210 is set in advance to reduce the rocking speed so that the orientation of the rocker cam 210 is switched from the outward motion to the returning motion within a section of a predetermined rocking angle range extending to the fully lifted state of the valve 202 shown in FIG. 8D. In a predetermined rocking angle range section following the fully lifted state of the valve 202, the force with which the rocker cam 210 pushes the valve 202 via the rocker arm 240 decreases. Even when the pushing force applied to the rocker arm 240 by the rocker cam 210 decreases, the rocker arm 240 may continue to displace in the opening direction of the valve 202 due to the inertial force acting on the rocker arm 240 such that the rocker arm 240 is separated from the rocker cam 210. This separation leads to the above-described irregular motion in the rocker arm 240. However, in the variable valve device 200, the restricting member 242 formed on the rocker arm 240 contacts the lift restricting cam portion 212 of the rocker cam 210, and therefore the rocker arm 240 is substantially prevented from separating from the rocker cam 210. Hence, irregular motion in the rocker arm 240 can be prevented.

When the valve lift increases, the inertial force acting on the rocker arm 240 increases, but in this case also, the restricting member 242 of the rocker arm 240 contacts the lift restricting cam portion 212 of the rocker cam 210, thereby preventing further rocking of the rocker arm 240. Hence, even when the valve lift increases, an excessive compressive force does not act on the valve spring 202*b* that elastically supports the valve 202.

It should be noted that the lift restricting cam portion 212 and the restricting member 242 also oppose each other via the small gap in the states shown in FIGS. 8A-8C, i.e. states other than the fully lifted state, and therefore separation of the cam follower 241 from the driving cam portion 211 is restricted at all times. Hence, irregular motion in the rocker arm 240 can be prevented in the entire rocking region of the rocker cam 210.

The recessed portion 244 prevents interference between the rocker cam 210 and the rocker arm 240 while the rocker cam 210 reciprocates.

Figures 9A, 9B, 9C, 9D:
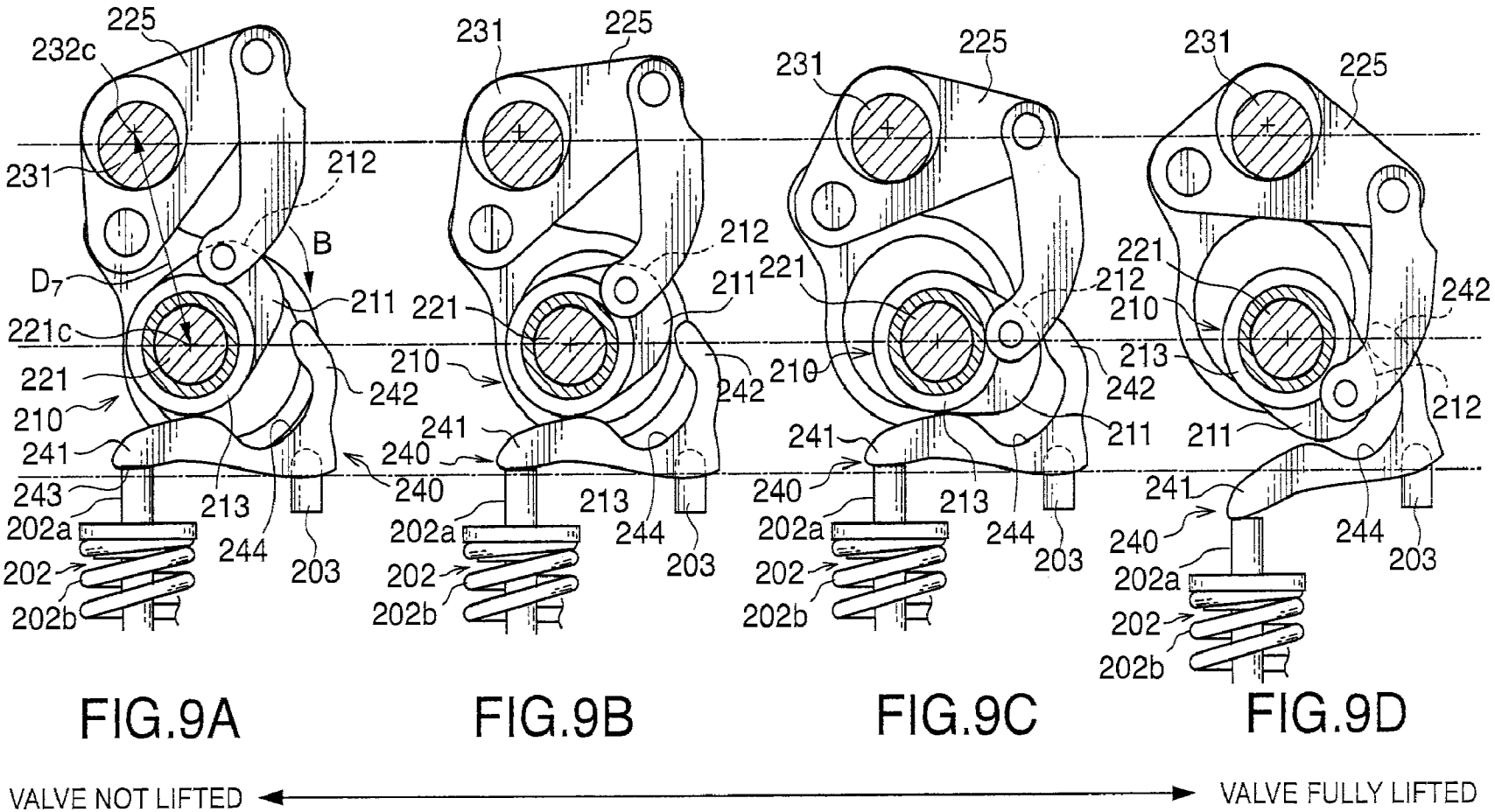
FIGS. 9A-9D are longitudinal sectional views illustrating a relationship between the rocking of the rocker cam at a minimum operating angle and the valve lift in the valve operating device according to the second embodiment of the invention.

FIGS. 9A-9D show the manner in which the valve 202 shifts from the non-lifted state to the fully lifted state when the distance between the rocking center 232*c* of the connecting arm 225 and the center 221*c* of the drive shaft 221 is set at a maximum distance D7 such that the lift amount and operating angle are at a minimum. These figures show the lift of the valve 202 generated by the rocking of the rocker cam 210. FIG. 9A shows a state in which the valve 202 is not lifted. FIG. 9D shows a state in which the valve 202 is fully lifted.

In this setting also, the valve 202 is lifted in accordance with the outward motion of the rocker cam 210 in a similar manner to the maximum operating angle setting shown in FIGS. 8A-8D. In FIG. 9D, the restricting member 242 contacts the lift restricting cam portion 212 when a large inertial force acts on the rocker arm 240 due to an increase in the rocking acceleration of the rocker cam 210, and therefore the rocker arm 240 is prevented from rocking beyond the small gap range.

The second embodiment described above exhibits similar effects to the first embodiment.

In addition, in the second embodiment, the driving cam portion 211 of the rocker cam 210 is positioned closer to the center line 203*c* of the pivot pin 203 than the center 221*c* of the drive shaft 221, and therefore the sliding contact portion 245 faces the contact portion 247. Hence, a base circle of the rocker cam 210 can be set large. As a result, interference between the rocker arm 240 and the lift restricting cam portion 212 is eliminated, and therefore a wide rocking range can be secured for the rocker cam 210.

Further, in the vicinity of the maximum positive acceleration of the rocker cam 210, the rocker ratio of the rocker arm 240 increases relative to the rocker ratio in the other lift states such that when the valve 202 is lifted, the sliding contact portion 245 moves in a direction for increasing the rocker ratio. Hence, the lift of the valve 202 can be increased without increasing the size of the valve operating system.

Figures 10A, 10B, 10C:
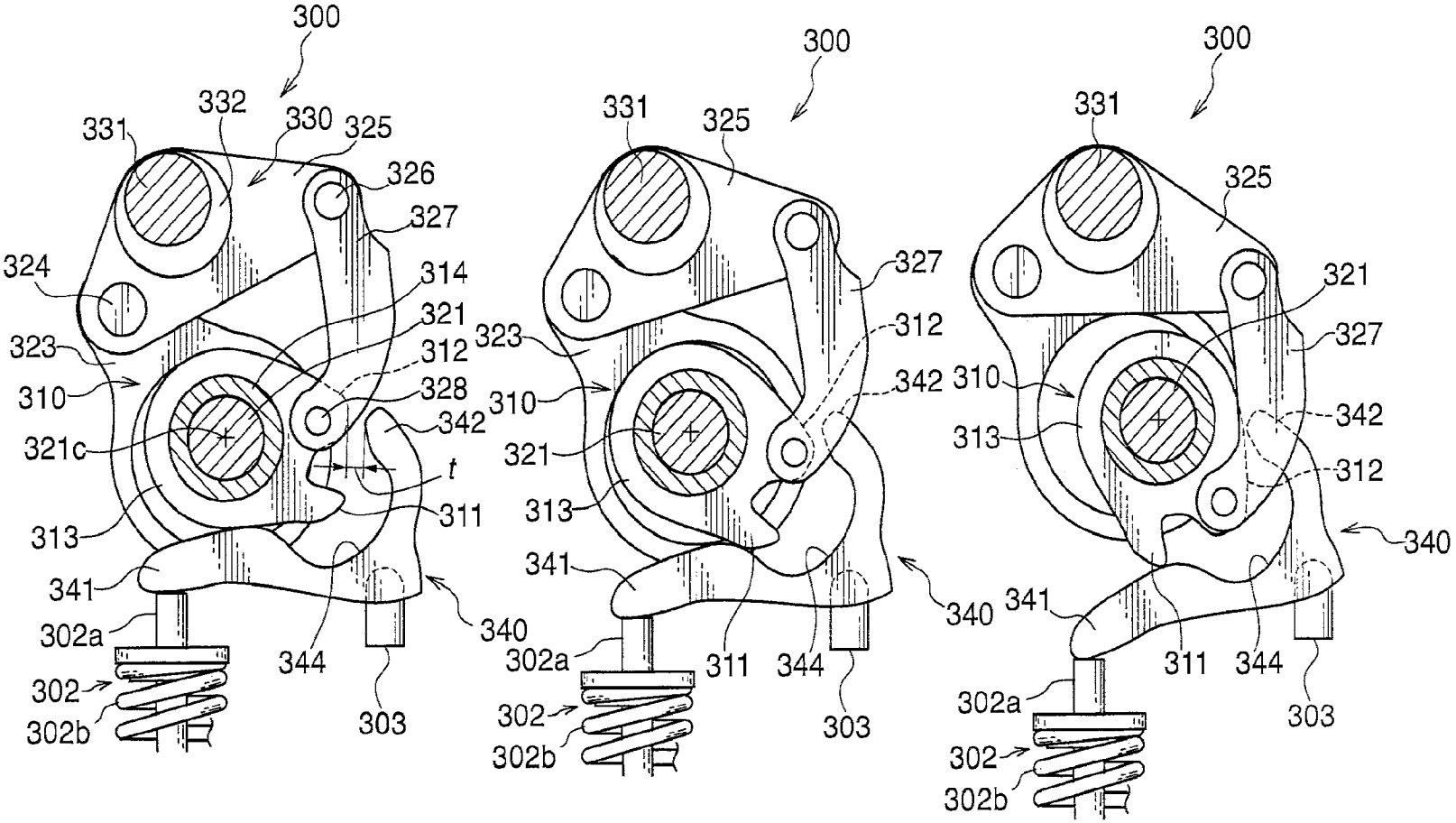
FIGS. 10A-10C are longitudinal sectional views illustrating a relationship between the rocking of the rocker cam and the valve lift in a valve operating device according to a third embodiment of the invention.

Referring to FIGS. 10A-10C, a variable valve device 300 according to a third embodiment of this invention will be described.

The variable valve device 300 is similar to the variable valve device 200 according to the second embodiment, but differs from the variable valve device 200 in having a different rocker cam 310 to the rocker cam 210 of the variable valve device 200.

A rocker cam driving mechanism 320, a variable lift mechanism 330, and a rocker arm 340 of the variable valve device 300 are constituted identically to the rocker cam driving mechanism 220, variable lift mechanism 230, and rocker arm 240 of the second embodiment. More specifically, a drive shaft 321, a center 321*c* of the drive shaft 321, a connecting tube 314, an eccentric cam 322, a first link 323, a ring-shaped portion 323*a*, a connecting pin 324, a connecting arm 325, a control shaft 331, a cam portion 332, a connecting pin 326, a second link 327, a connecting pin 328, a cam follower 341, a restricting member 342, a recessed portion 344, a valve 302, a stem end 302*a*, a valve spring 302*b*, and a pivot pin 303 are constituted identically to the drive shaft 221, the center 221*c* of the drive shaft 221, the connecting tube 214, the eccentric cam 222, the first link 223, the ring-shaped portion 223*a*, the connecting pin 224, the connecting arm 225, the control shaft 231, the cam portion 232, the connecting pin 226, the second link 227, the connecting pin 228, the cam follower 241, the restricting member 242, the recessed portion 244, the valve 202, the stem end 202*a*, the valve spring 202*b*, and the pivot pin 203 of the second embodiment, respectively.

In the second embodiment, the rocker cam 210 is shaped such that the gap between the lift restricting cam portion 212 of the rocker cam 210 and the restricting member 242 of the rocker arm 240 is held at the predetermined small gap regardless of the rocker cam angle. In the variable valve device 300 according to the third embodiment, on the other hand, the cam shape of the rocker cam 310 is set such that the gap between a lift restricting cam portion 312 and the restricting member 342 corresponds to the predetermined small gap only in the vicinity of maximum lift, in which irregular motion is most likely to occur in the rocker arm 340.

The cam surface of the rocker cam 310 is constituted by an arc-shaped base portion 313 centering on the center 321*c* of the drive shaft 321, a driving cam portion 311 for pushing the rocker arm 340, and the lift restricting cam portion 312 for preventing irregular motion in the rocker arm 340. The driving cam portion 311 opens the valve 302 by pushing the rocker arm 340.

The driving cam portion 311 has a cam profile that is suited to a preferable valve lift characteristic of the valve 302. The lift restricting cam portion 312 is shaped such that the gap between the lift restricting cam portion 312 and the restricting member 342 corresponds to the predetermined small gap only in the vicinity of peak lift. More specifically, when the cam follower 341 is about to separate from the driving cam portion 311 due to inertial force in the vicinity of peak lift, the restricting member 342 of the rocker arm 340 contacts the lift restricting cam portion 312, thereby substantially preventing the cam follower 341 from separating from the driving cam portion 311, and as a result, irregular motion in the valve 302 is prevented.

FIG. 10A shows the variable valve device 300 when the valve 302 is not lifted, and FIG. 10C shows the variable valve device 300 when the valve 302 is in the peak lift state.

As shown in FIG. 10A, when the port is closed by the valve 302, the base portion 313 of the rocker cam 310 contacts the cam follower 341 of the rocker arm 340. A gap t between the lift restricting cam portion 312 and the restricting member 342 in this case is larger than the predetermined small gap.

The rocker cam 310 moves from the base portion 313 toward the driving cam portion 311 so as to come gradually into contact with the cam follower 341, whereby a state shown in FIG. 10B is attained. In this section also, the gap between the lift restricting cam portion 312 and the restricting member 342 is larger than the predetermined small gap.

In the peak lift state, as shown in FIG. 10C, the gap between the lift restricting cam portion 312 and the restricting member 342 corresponds to the predetermined small gap. At the predetermined small gap, the restricting member 342 contacts the lift restricting cam portion 312 when the rocker arm 340 attempts to separate from the rocker cam 310 due to inertial force, and therefore separation of the rocker arm 340 is prevented.

According to this embodiment, the lift restricting cam portion 312 only approaches the restricting member 342 in the vicinity of peak lift, and therefore the lift restricting cam portion 312 can be reduced in size. Accordingly, further reductions in the size and weight of the variable valve device can be achieved.

Figure 11:
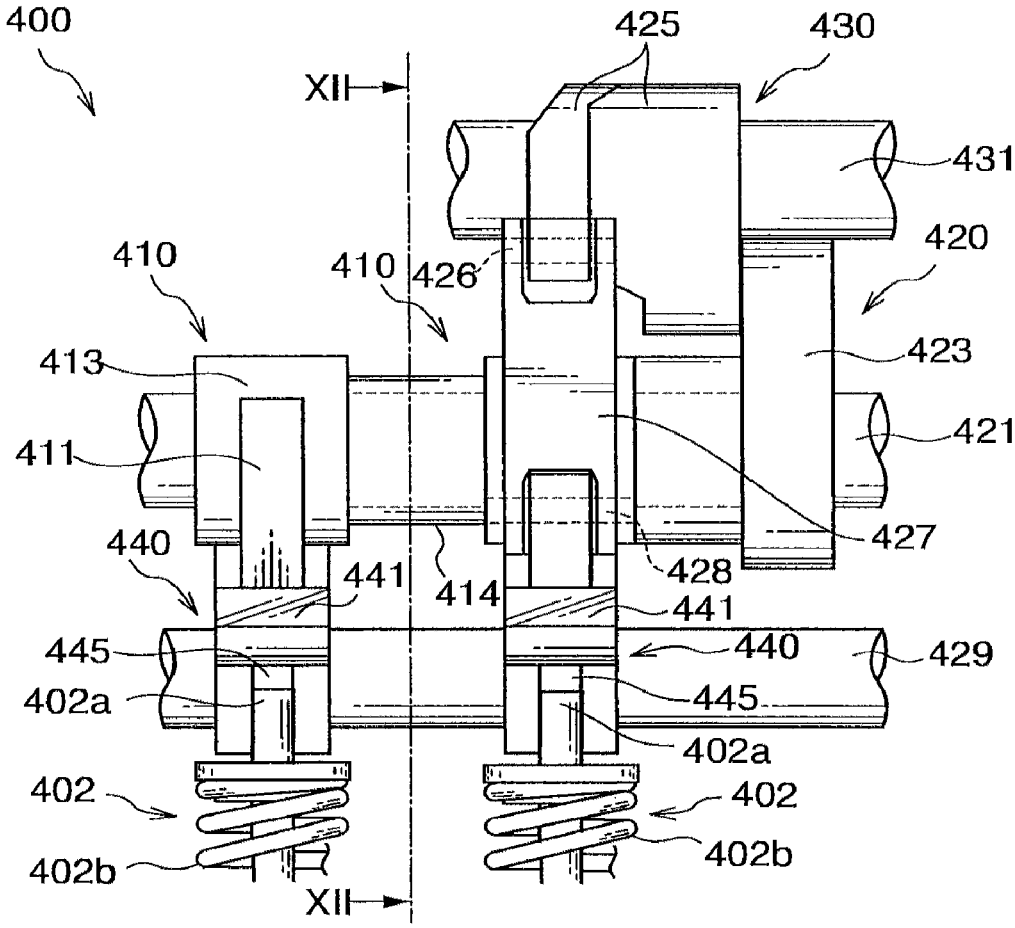
FIG. 11 is a front view of a valve operating device according to a fourth embodiment of the invention.
Figure 12:
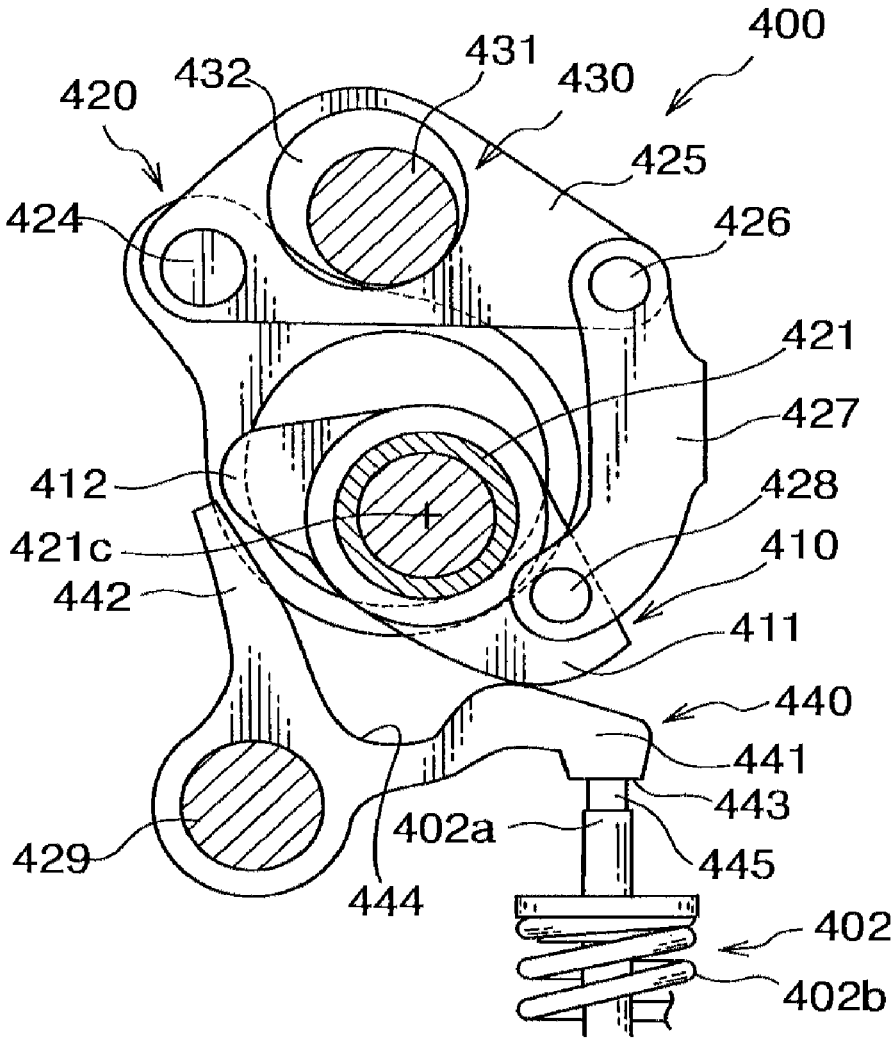
FIG. 12 is a longitudinal sectional view of the valve operating device according to the fourth embodiment of the invention, taken along a XII-XII line in FIG. 11.

Referring to FIGS. 11 and 12, a variable valve device 400 according to a fourth embodiment of this invention will be described.

A rocker cam 410, a rocker cam driving mechanism 420, and a variable lift mechanism 430 of the variable valve device 400 are constituted identically to the rocker cam 10, rocker cam driving mechanism 20, and variable lift mechanism 30 of the first embodiment. More specifically, a driving cam portion 411, a lift restricting cam portion 412, a base portion 413, a drive shaft 421, a center 421*c* of the drive shaft 421, a connecting tube 414, an eccentric cam 422, a first link 423, a ring-shaped portion 423*a*, a connecting pin 424, a connecting arm 425, a control shaft 431, a cam portion 432, a connecting pin 426, a second link 427, and a connecting pin 428 are constituted identically to the driving cam portion 11, the lift restricting cam portion 12, the drive shaft 21, the center 21*c* of the drive shaft 21, the connecting tube 14, the eccentric cam 22, the first link 23, the ring-shaped portion 23*a*, the connecting pin 24, the connecting arm 25, the control shaft 31, the cam portion 32, the connecting pin 26, the second link 27, and the connecting pin 28 of the first embodiment, respectively.

In the variable valve device 400, the structure of a rocker arm 440 differs from that of the rocker arm 40 according to the first embodiment.

The rocker arm 440 is fitted onto an outer periphery of a rocker shaft 429 to be free to rock. A cam follower 441, a restricting member 442, and a recessed portion 444 are formed integrally with the rocker arm 440.

Similarly to the first embodiment, a predetermined small gap is secured at all times between the restricting member 442 and the lift restricting cam portion 412 of the rocker cam 410. The restricting member 442 and the lift restricting cam portion 412 oppose each other via the predetermined small gap at all times, and therefore the restricting member 442 prevents the rocker arm 440 from rocking at or beyond a rocking angle corresponding to the small gap, regardless of the rocking angle of the rocker cam 410, in cases where the cam follower 441 is about to jump out from the driving cam portion 411.

The recessed portion 444 is formed between the cam follower 441 and the restricting member 442 to prevent interference with the rocker arm 440 when the rocker cam 410 rocks. An end portion 443 of the cam follower 441 contacts a stem end 402*a* of a valve 402 via a lash adjuster 445. The lash adjuster 445 is a well-known mechanism that adjusts a valve clearance automatically in relation to wear on the cam follower 441 and the stem end 402*a*. In this embodiment, in which the rocker arm 440 is supported by the rocker shaft 429, it is difficult to provide the rocking fulcrum of the rocker arm 440 with a valve clearance adjustment function, and therefore the lash adjuster 445 is provided on the end portion 443 of the rocker arm 440. The valve 402, stem end 402*a*, and valve spring 402*b* are identical to the valve 2, stem end 2*a*, and valve spring 2*b* of the first embodiment.

In this variable valve device 400, similarly to the variable valve device 100 according to the first embodiment, a favorable effect is obtained in terms of preventing irregular motion in the valve 402.

In addition, in the variable valve device 400, the following effects are obtained by having the rocker shaft 429 support the rocker arm 440. When the rocker arm 440 is supported by a pivot pin, as in the first embodiment, the rocker arm 440 is capable of rocking in a direction other than the rocking direction of the rocker cam 410. When the rocker arm 440 tilts in a direction other than the rocking direction of the rocker cam 410, the rocker arm 440 may deviate from the pivot pin, or the end portion 443 of the rocker arm 440 may become dislodged from the stem end 402*a* of the valve 402. According to this embodiment, the rocker arm 440 is supported by the rocker shaft 429, and therefore the rocking direction of the rocker arm 440 is limited to the rocking direction of the rocker cam 410. Hence, the problems described above can be prevented.

Providing the lash adjuster 445 on the end portion 443 of the cam follower 441 causes an increase in the inertial mass of the cam follower 441. However, separation of the cam follower 441 from the driving cam portion 411 is restricted by the restricting member 442 and the lift restricting cam portion 412, and therefore the increase in the inertial mass of the cam follower 441 does not affect the irregular motion prevention effect on the valve 402.

Figure 13:
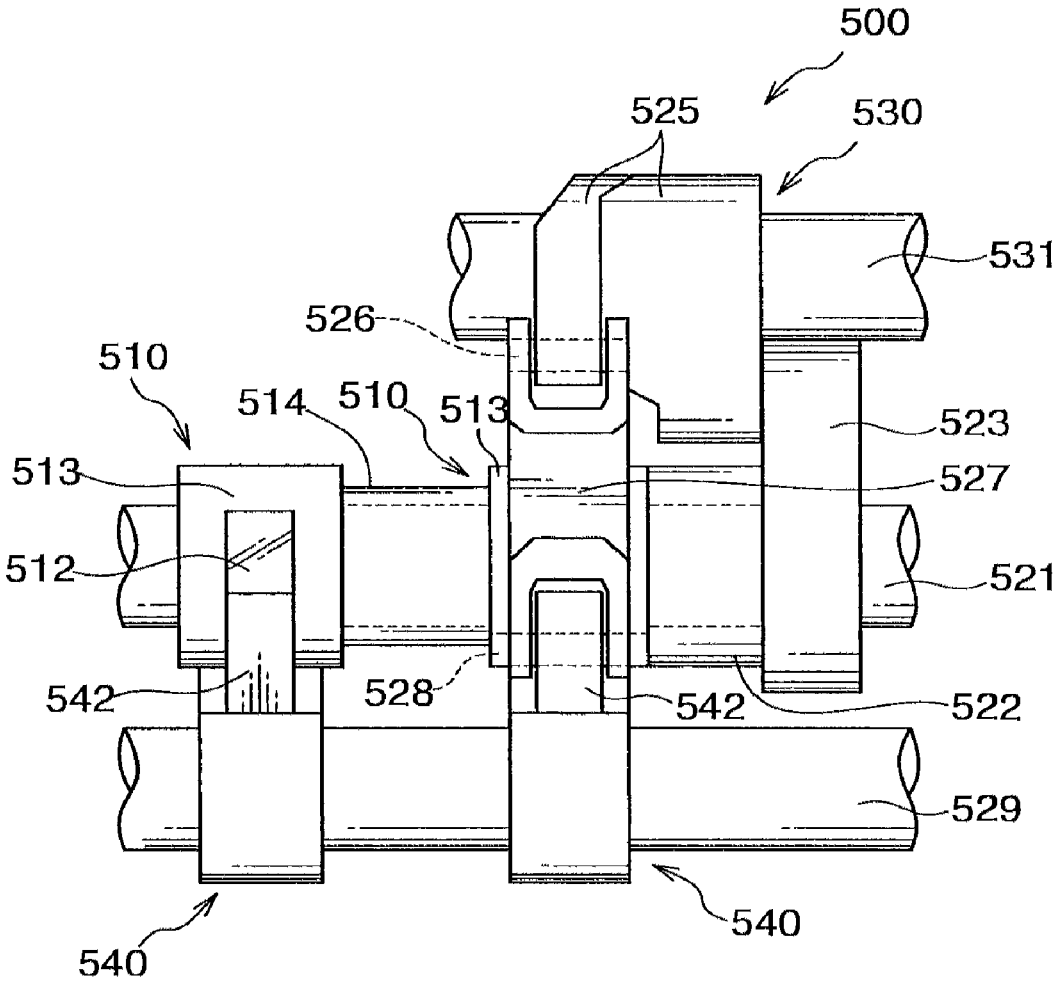
FIG. 13 is a front view of a valve operating device according to a fifth embodiment of the invention.
Figure 14:
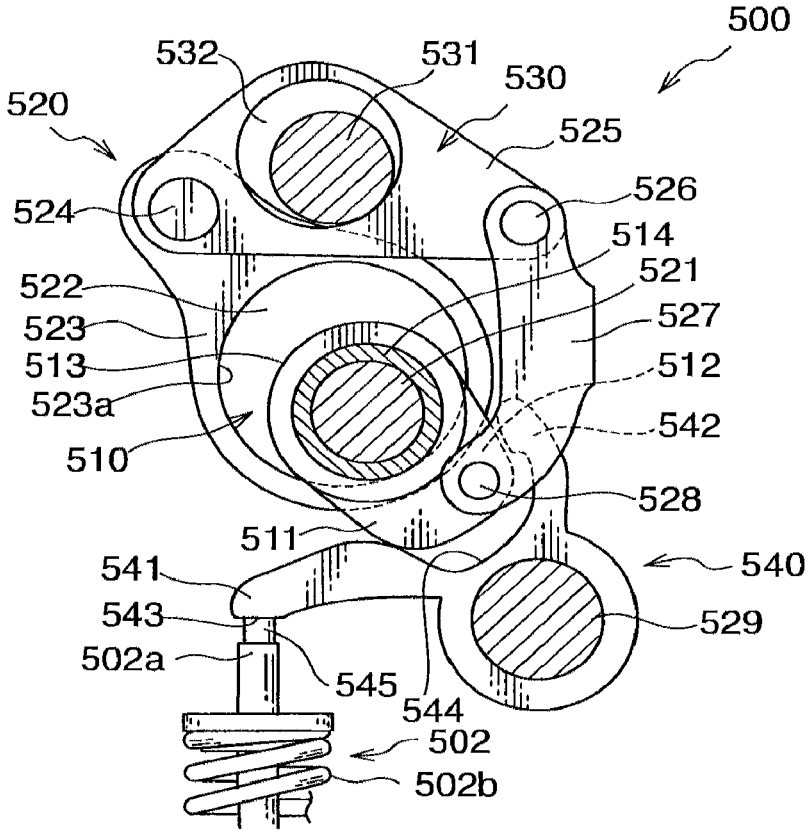
FIG. 14 is a longitudinal sectional view of the valve operating device according to the fifth embodiment of the invention, taken along a XIV-XIV line in FIG. 13.

Referring to FIGS. 13 and 14, a variable valve device 500 according to a fifth embodiment of this invention will be described.

The variable valve device 500 is similar to the variable valve device 200 according to the second embodiment, but the structure of a rocker arm 540 differs from the rocker arm 240 of the variable valve device 200.

A rocker cam 510, a rocker cam driving mechanism 520, and a variable lift mechanism 530 of the variable valve device 500 are constituted identically to the rocker cam 210, rocker cam driving mechanism 220, and variable lift mechanism 230 of the second embodiment. More specifically, a driving cam portion 511, a lift restricting cam portion 512, a base portion 513, a drive shaft 521, a center 521*c* of the drive shaft 521, a connecting tube 514, an eccentric cam 522, a first link 523, a ring-shaped portion 523*a*, a connecting pin 524, a connecting arm 525, a control shaft 531, a cam portion 532, a connecting pin 526, a second link 527, and a connecting pin 528 are constituted identically to the driving cam portion 211, the lift restricting cam portion 212, the base portion 213, the drive shaft 221, the center 221*c* of the drive shaft 221, the connecting tube 214, the eccentric cam 222, the first link 223, the ring-shaped portion 223*a*, the connecting pin 224, the connecting arm 225, the control shaft 231, the cam portion 232, the connecting pin 226, the second link 227, and the connecting pin 228 of the second embodiment, respectively.

The rocker arm 540 is fitted onto an outer periphery of a rocker shaft 529 to be free to rock. A cam follower 541, a restricting member 542, and a recessed portion 544 are formed integrally in the rocker arm 540.

Similarly to the second embodiment, a predetermined small gap is secured at all times between the restricting member 542 and the lift restricting cam portion 512 of the rocker cam 510. The restricting member 542 and the lift restricting cam portion 512 oppose each other via the predetermined small gap at all times, and therefore the restricting member 542 prevents the rocker arm 540 from rocking at or beyond a rocking angle corresponding to the small gap, regardless of the rocking angle of the rocker cam 510, in cases where the cam follower 541 is about to jump out from the driving cam portion 511.

The recessed portion 544 is formed between the cam follower 541 and the restricting member 542 to prevent interference with the rocker arm 540 when the rocker cam 510 rocks. An end portion 543 of the cam follower 541 contacts a stem end 502*a* of a valve 502 via a lash adjuster 545. The lash adjuster 545 is a well-known mechanism that adjusts a valve clearance automatically in relation to wear on the cam follower 541 and the stem end 502*a*. In this embodiment, in which the rocker arm 540 is supported by the rocker shaft 529, it is difficult to provide the rocking fulcrum of the rocker arm 540 with a valve clearance adjustment function, and therefore the lash adjuster 545 is provided on the end portion 543 of the rocker arm 540. The valve 502, stem end 502*a*, and valve spring 502*b* are identical to the valve 202, stem end 202*a*, and valve spring 202*b* of the second embodiment.

In this variable valve device 500, similarly to the variable valve device 200 according to the second embodiment, a favorable effect is obtained in terms of preventing irregular motion in the valve 502.

In addition, in the variable valve device 500, the following effects are obtained by having the rocker shaft 529 support the rocker arm 540. When the rocker arm 540 is supported by a pivot pin, as in the second embodiment, the rocker arm 540 is capable of rocking in a direction other than the rocking direction of the rocker cam 510. When the rocker arm 540 tilts in a direction other than the rocking direction of the rocker cam 510, the rocker arm 540 may become dislodged from the pivot pin, or the end portion 543 of the rocker arm 540 may deviate from the stem end 502*a* of the valve 502. According to this embodiment, the rocker arm 540 is supported by the rocker shaft 529, and therefore the rocking direction of the rocker arm 540 is limited to the rocking direction of the rocker cam 510. Hence, the problems described above can be prevented.

Providing the lash adjuster 545 on the end portion 543 of the cam follower 541 causes an increase in the inertial mass of the cam follower 541. However, separation of the cam follower 541 from the driving cam portion 511 is restricted by the restricting member 542 and the lift restricting cam portion 512, and therefore the increase in the inertial mass of the cam follower 541 does not affect the irregular motion prevention effect on the valve 502.

Figure 15:
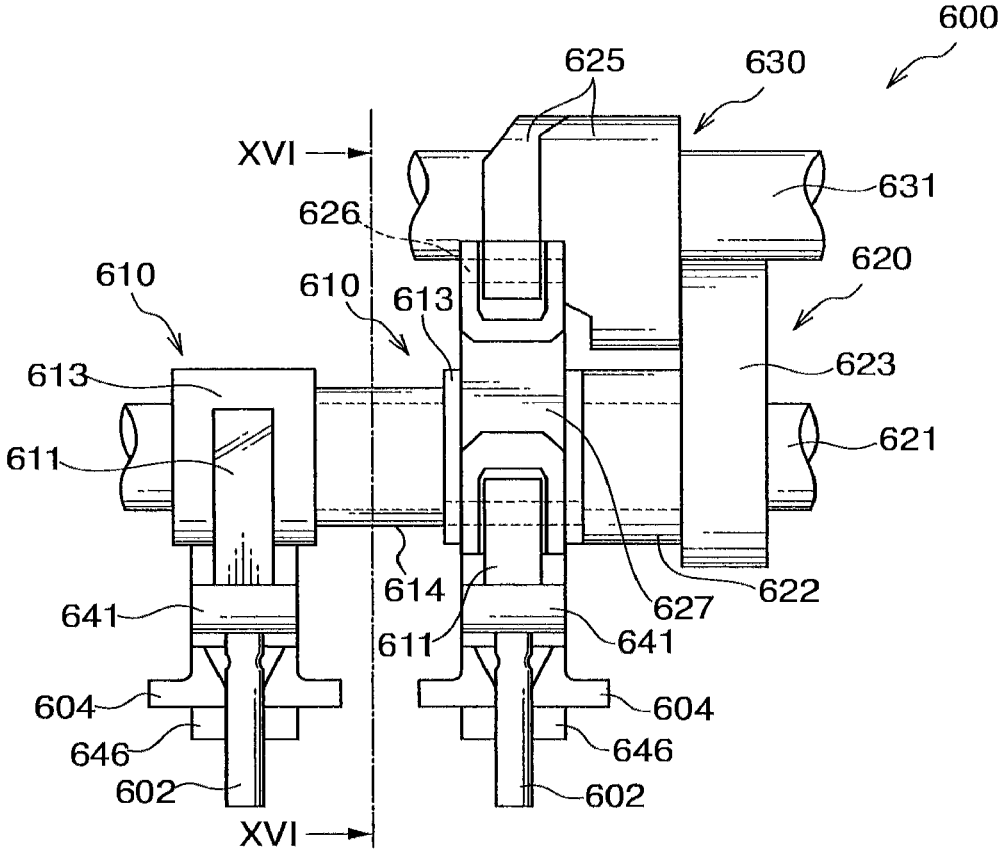
FIG. 15 is a front view of a valve operating device according to a sixth embodiment of the invention.
Figure 16:
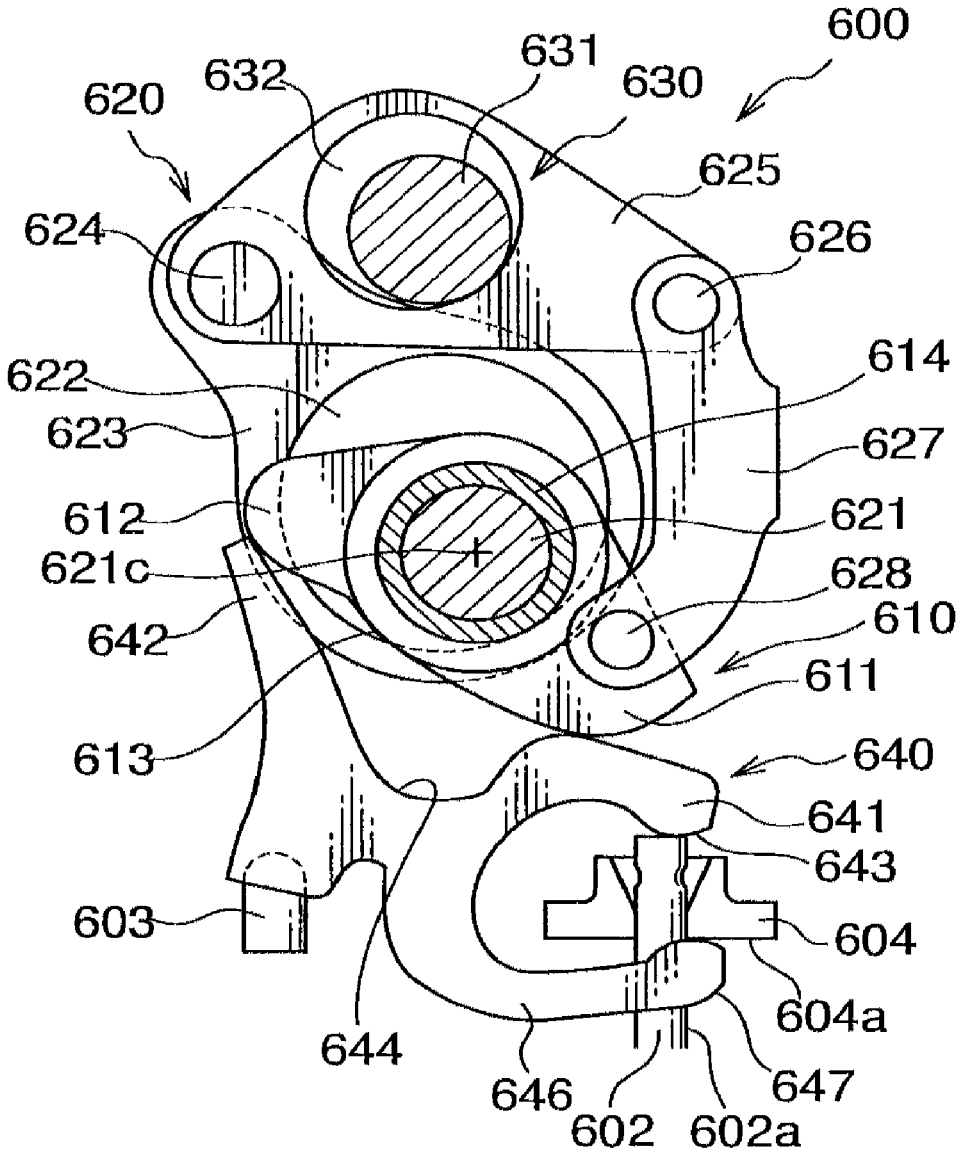
FIG. 16 is a longitudinal sectional view of the valve operating device according to the sixth embodiment of the invention, taken along a XVI-XVI line in FIG. 15.

Referring to FIGS. 15 and 16, a variable valve device 600 according to a sixth embodiment of this invention will be described.

The variable valve device 600 is similar to the variable valve device 100 according to the first embodiment, but the structure of a rocker arm 640 differs from the rocker arm 40 of the variable valve device 100.

A rocker cam 610, a rocker cam driving mechanism 620, and a variable lift mechanism 630 of the variable valve device 600 are constituted identically to the rocker cam 10, rocker cam driving mechanism 20, and variable lift mechanism 30 of the first embodiment. More specifically, a driving cam portion 611, a lift restricting cam portion 612, a base portion 613, a drive shaft 621, a center 621*c* of the drive shaft 621, a connecting tube 614, an eccentric cam 622, a first link 623, a ring-shaped portion 623*a*, a connecting pin 624, a connecting arm 625, a control shaft 631, a cam portion 632, a connecting pin 626, a second link 627, and a connecting pin 628 are constituted identically to the driving cam portion 11, the lift restricting cam portion 12, the base portion 13, the drive shaft 21, the center 21*c* of the drive shaft 21, the connecting tube 14, the eccentric cam 22, the first link 23, the ring-shaped portion 23*a*, the connecting pin 24, the connecting arm 25, the control shaft 31, the cam portion 32, the connecting pin 26, the second link 27, and the connecting pin 28 of the first embodiment, respectively.

A cam follower 641, a restricting member 642, a gripping portion 646, and a recessed portion 644 are formed integrally in the rocker arm 640. The rocker arm 640 is supported by a pivot pin 603, and rocks in accordance with the rocking of the rocker cam 610 using the pivot pin 603 as a fulcrum. The recessed portion 644 is formed between the cam follower 641 and the restricting member 642 to prevent interference between the rocker arm 640 and the rocker cam 610. In this embodiment, in contrast to the first embodiment, the shape and dimensions of the restricting member 642 and the lift restricting cam portion 612 are set such that the restricting member 642 contacts the lift restricting cam portion 612 slidingly at all times.

The gripping portion 646 extends toward a stem end 602*a* of a valve stem of a valve 602 below the cam follower 641. An end portion 647 of the gripping portion 646 contacts a lower surface 604*a* of a retainer 604 fixed in the vicinity of the stem end 602*a* from below. Meanwhile, an end portion 643 of the cam follower 641 of the rocker arm 640 contacts the stem end 602*a* of the valve 602 from above. As a result, the valve 602 is gripped between the cam follower 641 contacting the stem end 602*a* and the gripping portion 646 contacting the retainer 604 so as to be driven forcibly in accordance with the rocking of the rocker arm 640. Hence, in this embodiment, the valve spring is omitted. The end portion 643 of the cam follower 641 and the gripping portion 646 constitute a sub-arm of the rocker arm 640.

During the outward motion, in which the contact point between the rocker cam 610 and the cam follower 641 moves from the base portion 613 toward the driving cam portion 611, the driving cam portion 611 pushes the cam follower 641. In this process, the contact point between the lift restricting cam portion 612 of the driving cam portion 611 and the restricting member 642 moves in a tip end direction of the restricting member 642. As a result, the rocker arm 640 rocks in the clockwise direction of the figure, thereby pushing the valve stem down via the cam follower 641 such that the valve 602 is opened.

Meanwhile, during the returning motion, in which the contact point between the rocker cam 610 and the cam follower 641 moves from the driving cam portion 611 toward the base portion 613, the contact point between the lift restricting cam portion 612 and the restricting member 642 moves from the tip end of the restricting member 642 toward the recessed portion 644. As a result, the rocker arm 640 rocks in the counter-clockwise direction of the figure, whereby the gripping portion 646 of the rocker arm 640 pulls the valve stem up via the retainer 604. Thus, the valve 602 is closed.

In the variable valve device 600, the cam follower 641 slidingly contacts the driving cam portion 611, the restricting member 642 slidingly contacts the lift restricting cam portion 612, and the valve 602 is gripped between the cam follower 641 and the gripping portion 646. With this constitution, even when the rotation speed of the internal combustion engine increases, leading to an increase in the rocking acceleration of the rocker cam 610, the rocker arm 640 does not separate from the rocker cam 610 and the valve 602 does not separate from the rocker arm 640, and as a result, irregular valve motion can be prevented reliably.

Moreover, in the variable valve device 600, the rocker arm 640 and the valve 602 are mechanically joined by the cam follower 641 and the gripping portion 646, and therefore the valve 602 does not require a valve spring. By omitting the valve spring, the number of components of the variable valve device 600 is reduced. Hence, according to the variable valve device of this embodiment, a reduction in manufacturing cost and an improvement in ease of assembly are achieved.

Figure 17:
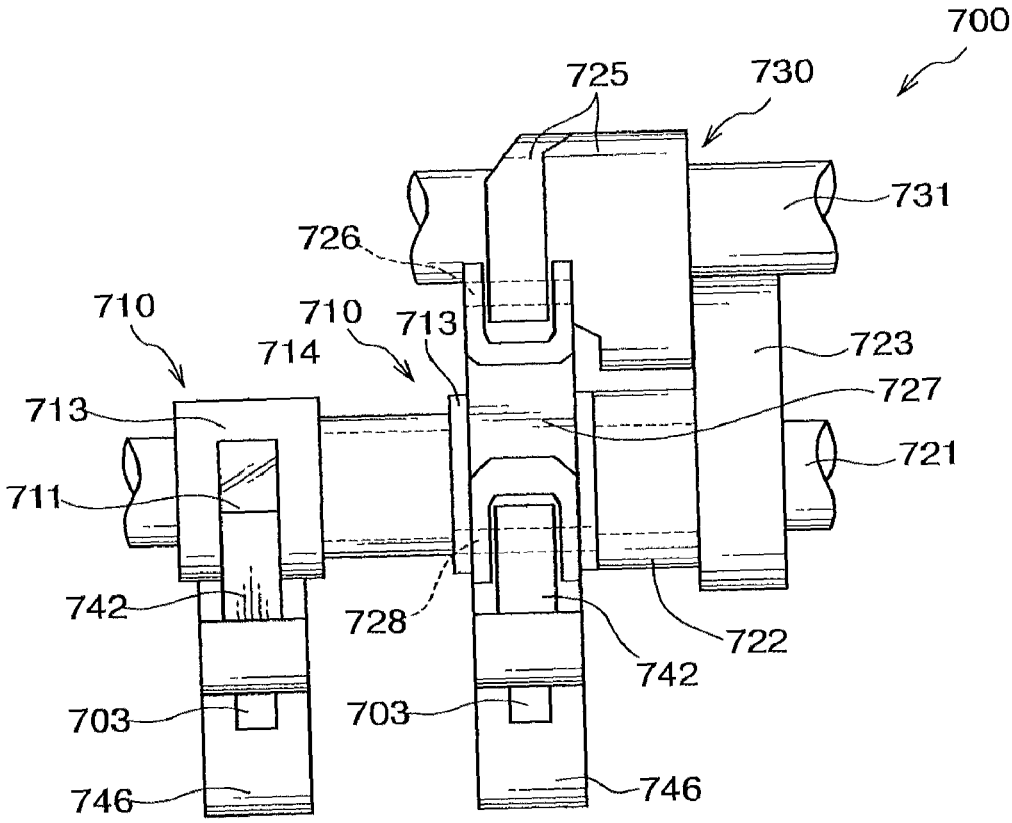
FIG. 17 is a front view of a valve operating device according to a seventh embodiment of the invention.
Figure 18:
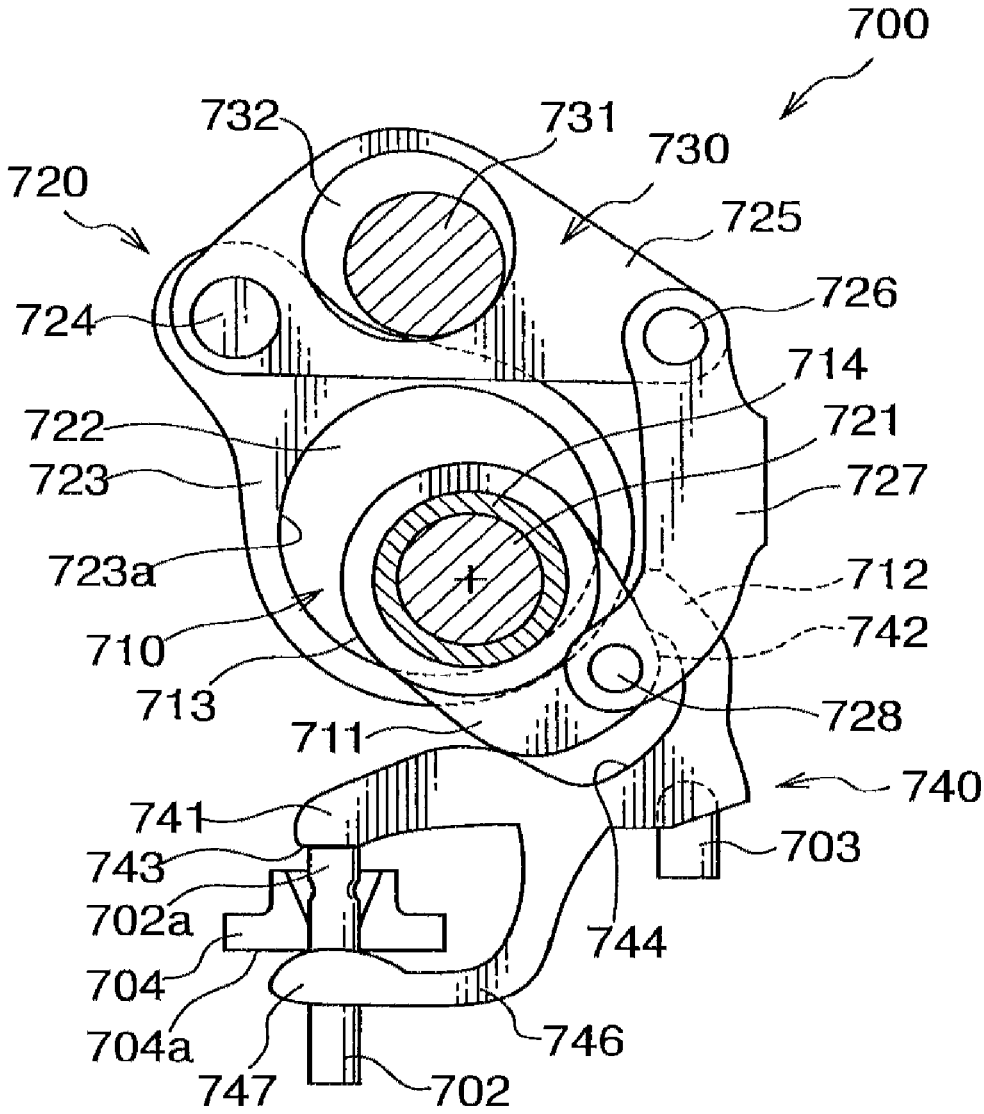
FIG. 18 is a longitudinal sectional view of the valve operating device according to the seventh embodiment of the invention, taken along a XVIII-XVIII line in FIG. 17.

Referring to FIGS. 17 and 18, a variable valve device 700 according to a seventh embodiment of this invention will be described.

The variable valve device 700 is similar to the variable valve device 200 according to the second embodiment, but the structure of a rocker arm 740 differs from the rocker arm 240 of the variable valve device 200.

A rocker cam 710, a rocker cam driving mechanism 720, and a variable lift mechanism 730 of the variable valve device 700 are constituted identically to the rocker cam 210, rocker cam driving mechanism 220, and variable lift mechanism 230 of the second embodiment. More specifically, a driving cam portion 711, a lift restricting cam portion 712, a base portion 713, a drive shaft 721, a center 721*c* of the drive shaft 721, a connecting tube 714, an eccentric cam 722, a first link 723, a ring-shaped portion 723*a*, a connecting pin 724, a connecting arm 725, a control shaft 731, a cam portion 732, a connecting pin 726, a second link 727, and a connecting pin 728 are constituted identically to the driving cam portion 211, the lift restricting cam portion 212, the base portion 213, the drive shaft 221, the center 221*c* of the drive shaft 221, the connecting tube 214, the eccentric cam 222, the first link 223, the ring-shaped portion 223*a*, the connecting pin 224, the connecting arm 225, the control shaft 231, the cam portion 232, the connecting pin 226, the second link 227, and the connecting pin 228 of the second embodiment, respectively.

A cam follower 741, a restricting member 742, a gripping portion 746, and a recessed portion 744 are formed integrally in the rocker arm 740. The rocker arm 740 is supported by a pivot pin 703, and rocks in accordance with the rocking of the rocker cam 710 using the pivot pin 703 as a fulcrum. The recessed portion 744 is formed between the cam follower 741 and the restricting member 742 to prevent interference between the rocker arm 740 and the rocker cam 710. In this embodiment, in contrast to the second embodiment, the shape and dimensions of the restricting member 742 and lift restricting cam portion 712 are set such that the restricting member 742 contacts the lift restricting cam portion 712 slidingly at all times.

The gripping portion 746 extends toward a stem end 702*a* of a valve stem of a valve 702 below the cam follower 741. An end portion 747 of the gripping portion 746 contacts a lower surface 704*a* of a retainer 704 fixed in the vicinity of the stem end 702*a* from below. Meanwhile, an end portion 743 of the cam follower 741 of the rocker arm 740 contacts the stem end 702*a* of the valve 702 from above. As a result, the valve 702 is gripped between the cam follower 741 contacting the stem end 702*a* and the gripping portion 746 contacting the retainer 704 so as to be driven forcibly in accordance with the rocking of the rocker arm 740. Hence, in this embodiment, the valve spring is omitted. The end portion 743 of the cam follower 741 and the gripping portion 746 constitute a sub-arm of the rocker arm 740.

During the outward motion, in which the contact point between the rocker cam 710 and the cam follower 741 moves from the base portion 713 toward the driving cam portion 711, the driving cam portion 711 of the rocker cam 710 pushes the cam follower 741 of the rocker arm 740. In this process, the contact point between the restricting member 742 and the lift restricting cam portion 712 moves in the direction of the base portion 713. As a result, the rocker arm 740 rocks in the counter-clockwise direction of the figure, thereby pushing the stem end 702*a* down via the cam follower 741 such that the valve 702 is opened.

Meanwhile, during the returning motion, in which the contact point between the rocker cam 710 and the cam follower 741 moves from the driving cam portion 711 toward the base portion 713, the lift restricting cam portion 712 of the rocker cam 710 pushes the restricting member 742 of the rocker arm 740. In this process, the contact point between the restricting member 742 and the lift restricting cam portion 712 moves in the tip end direction of the lift restricting cam portion 712. As a result, the rocker arm 740 rocks in the clockwise direction of the figure, whereby the gripping portion 746 pulls the stem end 702*a* up via the retainer 704. Thus, the valve 702 is closed.

In the variable valve device 700, the cam follower 741 slidingly contacts the driving cam portion 711, the restricting member 742 slidingly contacts the lift restricting cam portion 712, and the valve 702 is gripped between the cam follower 741 and the gripping portion 746. With this constitution, even when the rotation speed of the internal combustion engine increases, leading to an increase in the rocking acceleration of the rocker cam 710, the rocker arm 740 does not separate from the rocker cam 710 and the valve 702 does not separate from the rocker arm 740, and as a result, irregular valve motion can be prevented reliably.

Moreover, in the variable valve device 700, the rocker arm 740 and the valve 702 are mechanically joined by the cam follower 741 and the gripping portion 746, and therefore the valve 702 does not require a valve spring. By omitting the valve spring, the number of components of the variable valve device 700 is reduced. Hence, according to the variable valve device of this embodiment, a reduction in manufacturing cost and an improvement in ease of assembly are achieved.

Figure 19:
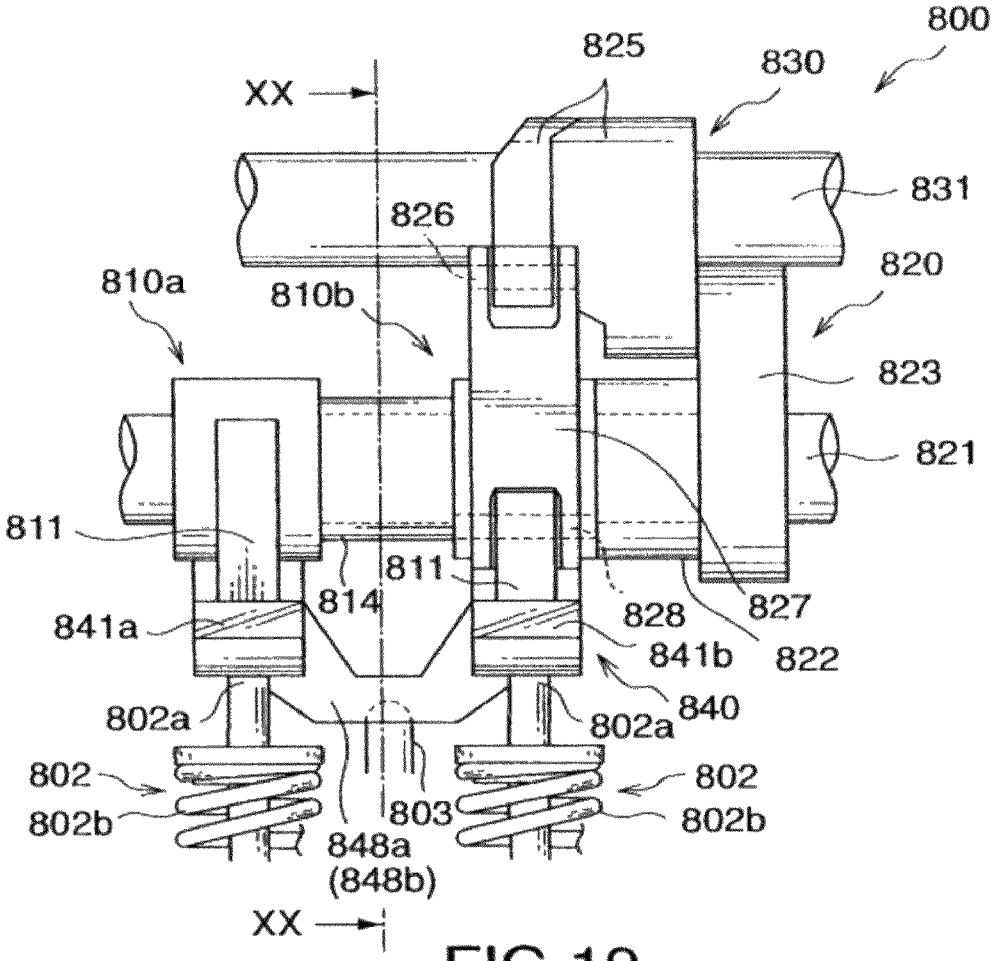
FIG. 19 is a front view of a valve operating device according to an eighth embodiment of the invention.
Figure 20:
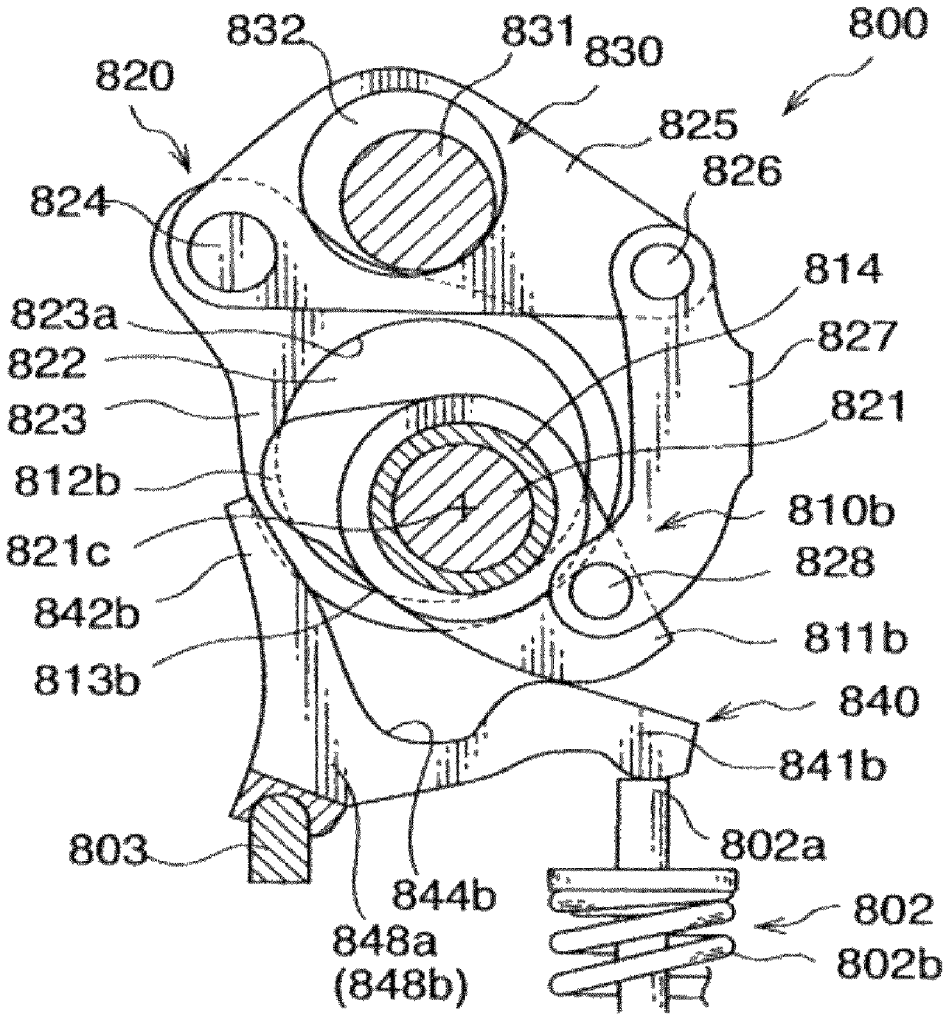
FIG. 20 is a longitudinal sectional view of the valve operating device according to the eighth embodiment of the invention, taken along a XX-XX line in FIG. 19.

Referring to FIGS. 19 and 20, a variable valve device 800 according to an eighth embodiment of this invention will be described.

The variable valve device 800 is similar to the variable valve device 100 according to the first embodiment, but the structure of a rocker arm 840 differs from the rocker arm 40 of the variable valve device 100.

A rocker cam 810, a rocker cam driving mechanism 820, and a variable lift mechanism 830 of the variable valve device 800 are constituted identically to the rocker cam 10, rocker cam driving mechanism 20, and variable lift mechanism 30 of the first embodiment. More specifically, a driving cam portion 811, a lift restricting cam portion 812, a base portion 813, a drive shaft 821, a center 821*c* of the drive shaft 821, a connecting tube 814, an eccentric cam 822, a first link 823, a ring-shaped portion 823*a*, a connecting pin 824, a connecting arm 825, a control shaft 831, a cam portion 832, a connecting pin 826, a second link 827, and a connecting pin 828 are constituted identically to the driving cam portion 11, the lift restricting cam portion 12, the base portion 13, the drive shaft 21, the center 21*c* of the drive shaft 21, the connecting tube 14, the eccentric cam 22, the first link 23, the ring-shaped portion 23*a*, the connecting pin 24, the connecting arm 25, the control shaft 31, the cam portion 32, the connecting pin 26, the second link 27, and the connecting pin 28 of the first embodiment, respectively.

In the variable valve device 100 according to the first embodiment, the pair of rocker cams 10 drive the pair of rocker arms 40, but in the variable valve device 800, a single rocker arm 840 is provided in relation to the pair of rocker cams 810.

As shown in FIG. 19, the rocker arm 840 is supported by a pivot pin 803 disposed between the pair of rocker cams 810. The rocker arm 840 includes forked arms 848*a*, 848*b* that bifurcate from the vicinity of a support portion of the pivot pin 803.

Referring to FIG. 20, a cam follower 841*a* that slidingly contacts the rocker cam 810 connected to the second link 827, of the pair of rocker cams 810, projects from a tip end of the arm 848*a* at a right angle to the drive shaft 821 and in a substantially horizontal direction. A cam follower 841*b* that slidingly contacts the other rocker cam 810 of the pair is formed on the other arm 848*b* in parallel with the cam follower 841*a*. Further, restricting members 842*a*, 842*b* are formed in an upward orientation on tip ends of the respective arms 848*a*, 848*b*. A recessed portion 844*a* is formed between the cam follower 841*a* and the restricting member 842*a*, and a recessed portion 844*b* is formed between the cam follower 841*b* and the restricting member 842*b*. A valve 802, a stem end 802*a*, and a valve spring 802*b* are equivalent to the valve 2, stem end 2*a*, and valve spring 2*b* of the first embodiment.

Hence, the rocker arm 840 is formed to be symmetrical about a center line of the pivot pin 803. As a result, the rocker arm 840 is greater in size and inertial mass than the individual rocker arms 40 according to the first embodiment. In comparison with the rocker arm 40 according to the first embodiment, the rocker arm 840 is more likely to separate from the rocker cam 810 even when the rocking acceleration of the rocker cam 810 is low. However, separation of the cam followers 841*a*, 841*b* from the driving cam portion 811 is substantially prevented by the contact between the restricting members 842*a*, 842*b* and the lift restricting cam portions 812 of the respective rocker cams 810, and therefore a similar favorable effect to that of the first embodiment is obtained in terms of preventing irregular motion in the valve 802.

Moreover, in the variable valve device 800, only one rocker arm 840 and only one pivot pin 803 are required in relation to the pair of rocker cams 810, and therefore the number of components is smaller than that of the variable valve device 100 according to the first embodiment. Hence, in the variable valve device according to this embodiment, a reduction in manufacturing cost and an improvement in ease of assembly are achieved.

Figure 21:
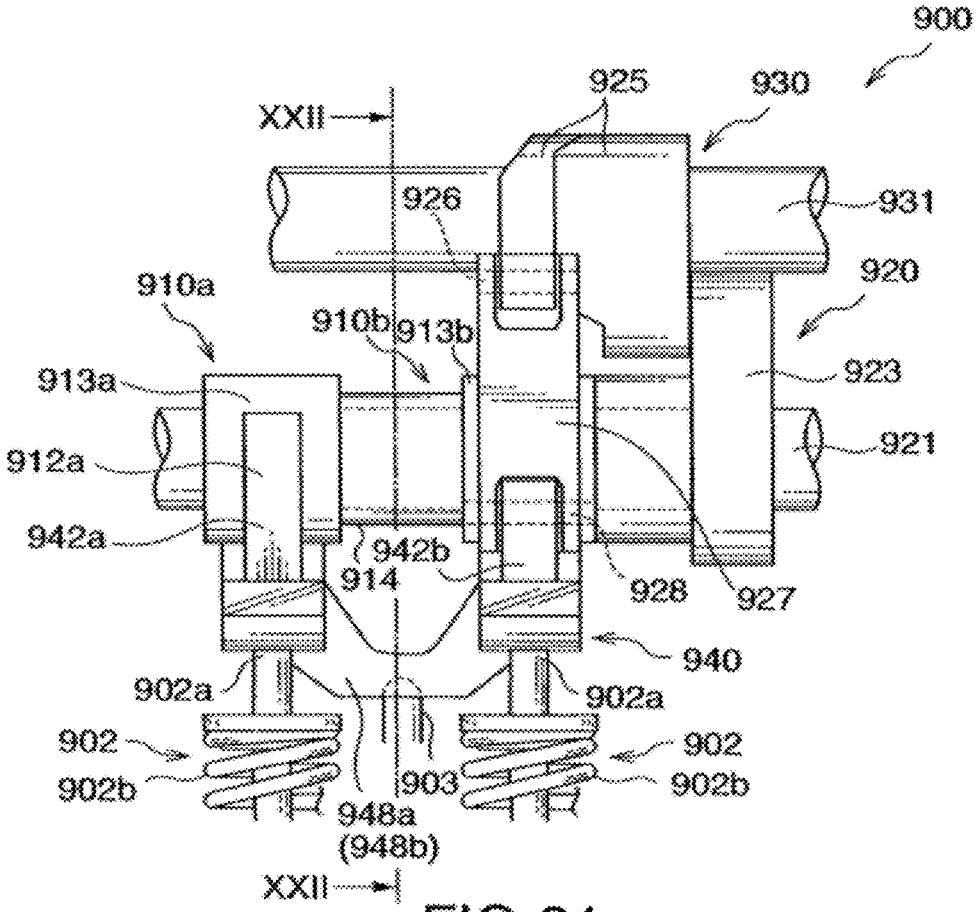
FIG. 21 is a front view of a valve operating device according to a ninth embodiment of the invention.
Figure 22:
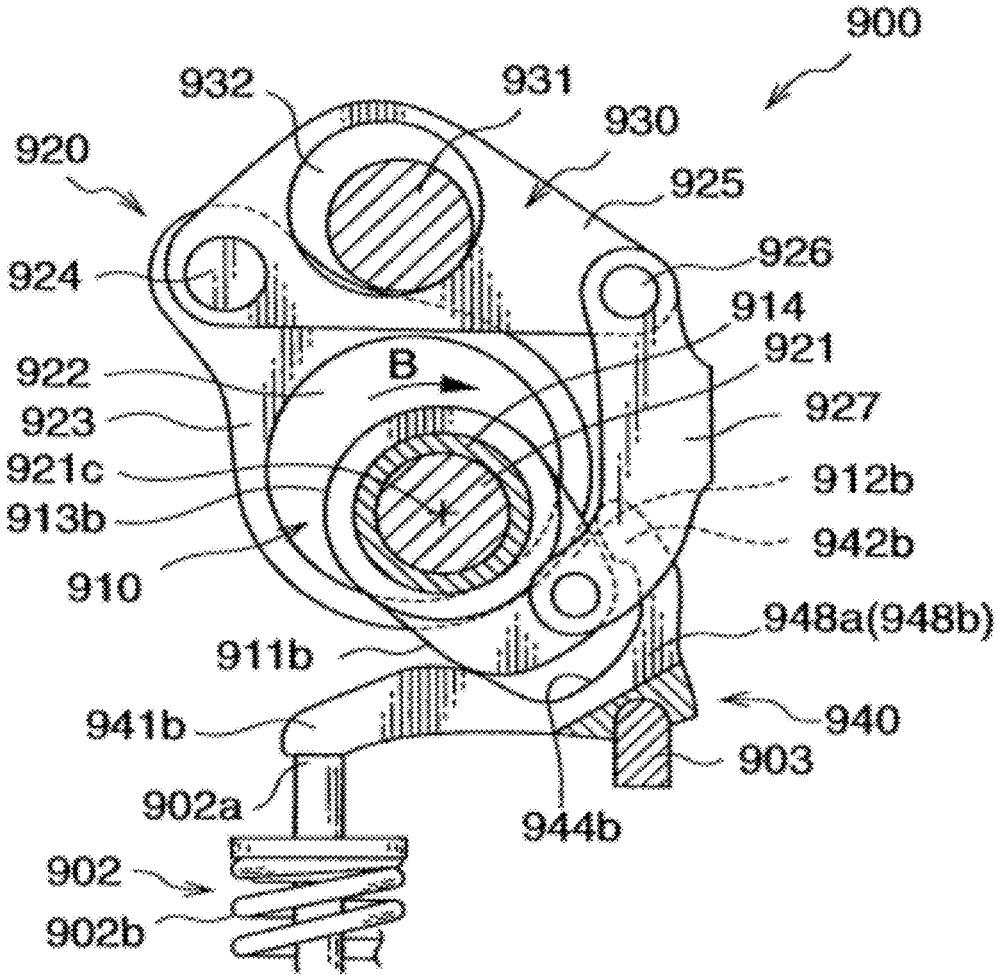
FIG. 22 is a longitudinal sectional view of the valve operating device according to the ninth embodiment of the invention, taken along a XXII-XXII line in FIG. 21.

Referring to FIGS. 21 and 22, a variable valve device 900 according to a ninth embodiment of this invention will be described.

The variable valve device 900 is similar to the variable valve device 200 according to the second embodiment, but the structure of a rocker arm 940 differs from the rocker arm 240 of the variable valve device 200.

A rocker cam 910, a rocker cam driving mechanism 920, and a variable lift mechanism 930 of the variable valve device 900 are constituted identically to the rocker cam 210, rocker cam driving mechanism 220, and variable lift mechanism 230 of the second embodiment. More specifically, a driving cam portion 911, a lift restricting cam portion 912, a base portion 913, a drive shaft 921, a center 921*c* of the drive shaft 921, a connecting tube 914, an eccentric cam 922, a first link 923, a ring-shaped portion 923*a*, a connecting pin 924, a connecting arm 925, a control shaft 931, a cam portion 932, a connecting pin 926, a second link 927, and a connecting pin 928 are constituted identically to the driving cam portion 211, the lift restricting cam portion 212, the base portion 213, the drive shaft 221, the center 221*c* of the drive shaft 221, the connecting tube 214, the eccentric cam 222, the first link 223, the ring-shaped portion 223*a*, the connecting pin 224, the connecting arm 225, the control shaft 231, the cam portion 232, the connecting pin 226, the second link 227, and the connecting pin 228 of the second embodiment, respectively.

In the variable valve device 200 according to the second embodiment, the pair of rocker cams 210 drive the pair of rocker arms 240, but in the variable valve device 900, a single rocker arm 940 is provided in relation to the pair of rocker cams 910.

As shown in FIG. 21, the rocker arm 940 is supported by a pivot pin 903 disposed between the pair of rocker cams 910. The rocker arm 940 includes forked arms 948*a*, 948*b* that bifurcate from the vicinity of a support portion of the pivot pin 903.

Referring to FIG. 22, a cam follower 941*a* that slidingly contacts the rocker cam 910 connected to the second link 927, of the pair of rocker cams 910, projects from a tip end of the arm 948*a* at a right angle to the drive shaft 921 and in a substantially horizontal direction. A cam follower 941*b* that slidingly contacts the other rocker cam 910 of the pair is formed on the other arm 948*b* in parallel with the cam follower 941*a*. Further, restricting members 942*a*, 942*b* are formed in an upward orientation on tip ends of the respective arms 948*a*, 948*b*. A recessed portion 944*a* is formed between the cam follower 941*a* and the restricting member 942*a*, and a recessed portion 944*b* is formed between the cam follower 941*b* and the restricting member 942*b*. A valve 902, a stem end 902*a*, and a valve spring 902*b* are equivalent to the valve 202, stem end 202*a*, and valve spring 202*b* of the second embodiment.

Hence, the rocker arm 940 is formed to be symmetrical about a center line of the pivot pin 903. As a result, the rocker arm 940 is greater in size and inertial mass than the rocker arm 240 according to the second embodiment. In comparison with the rocker arm 240 according to the second embodiment, the rocker arm 940 is more likely to separate from the rocker cam 910 even when the rocking acceleration of the rocker cam 910 is low. However, separation of the cam followers 941*a*, 941*b* from the driving cam portion 911 is substantially prevented by the contact between the restricting members 942*a*, 942*b* and the lift restricting cam portions 912 of the respective rocker cams 910, and therefore a similar favorable effect to that of the second embodiment is obtained in terms of preventing irregular motion in the valve 902.

Moreover, in the variable valve device 900, only one rocker arm 940 and only one pivot pin 903 are required in relation to the pair of rocker cams 910, and therefore the number of components is smaller than that of the variable valve device 200 according to the second embodiment. Hence, according to this variable valve device, a reduction in manufacturing cost and an improvement in ease of assembly are achieved.

Of the first to ninth embodiments described above, in the first, fourth, sixth and eighth embodiments, the connecting pin 28 (428, 628, 828) connecting the second link 27 (427, 627, 827) and the rocker cam 10 (410, 610, 810) is positioned closer to the center line of the valve stem than the center 21*c* (421*c*, 621*c*, 821*c*) of the drive shaft 21 (421, 621, 821). Hence, in these embodiments, a horizontal direction offset between the second link 27 (427, 627, 827) and the valve stem is smaller than that of the second, third, fifth and seventh embodiments, and therefore compression stress generated in the second link 27 (427, 627, 827) when the second link 27 (427, 627, 827) pushes down the valve stem via the rocker cam 10 (410, 610, 810) can be suppressed to a low level. Furthermore, a distance between the connecting pin 28 (428, 628, 828) and the sliding contact portion 45 (445, 645, 845) is small, and therefore deformation of the rocker cam 10 (410, 610, 810) can also be suppressed. These characteristics are favorable in terms of increasing the rigidity of the variable valve device, and also enable an enlargement in the settable range of the lift of the valve 2 (402, 602, 802).

Further, in the first to third and sixth to ninth embodiments, the rocker arm 40 (240, 340, 640, 740, 840, 940) is supported by the pivot pin 3 (203, 303, 603, 703, 803, 903). In these embodiments, there is no need to provide a mechanism such as the lash adjuster 443 (543) for adjusting the valve clearance in the rocker arm 440 (540), as in the fourth and fifth embodiments where the rocker arm 440 (540) is supported by the rocker shaft 429 (529), and therefore the rocker arm can be reduced in weight. Furthermore, when the rocker arm 440 (540) is supported by the rocker shaft 429 (529), thickness must be secured in the rocker arm 440 (540) around the rocker shaft 429 (529), and therefore the size of the rocker arm 440 (540) increases. In the first to third and sixth to ninth embodiments, in which the rocker arm 40 (240, 340, 640, 740, 840, 940) is supported by the pivot pin 3 (203, 303, 603, 703, 803, 903), on the other hand, this increase in size can be avoided.

The contents of Tokugan No. 2007-068130, having a filing date of Mar. 16, 2007 in Japan, are incorporated into the above description by reference.

Although the invention has been described above with reference to certain embodiments, the invention is not limited to the embodiments described above. Modifications and variations of the embodiments described above will occur to those skilled in the art, within the scope of the claims.

For example, a similar rocker shaft to that of the fourth and fifth embodiments may be applied to the sixth to ninth embodiments.

The roller 250 shown in FIG. 7, which is applied to the contact portion between the rocker arm and the rocker cam, may be applied to any of the above embodiments.

In the above embodiments, the relationship between the lift restricting cam portion of the rocker cam and the restricting member of the rocker arm may be divided into the following three types: a case in which, during a normal operation, the predetermined small gap is always maintained between the lift restricting cam portion and the restricting member; a case in which the predetermined small gap is formed in the vicinity of the maximum acceleration of the rocker cam and a larger gap is formed in the other rocking positions of the rocker cam; and a case in which the lift restricting cam portion and the restricting member contact each other at all times either directly or via the roller. These three cases may be applied arbitrarily to all of the first to ninth embodiments.

In all of the above embodiments, this invention is applied to a valve operating device having a variable lift mechanism, but this invention may also be applied to a valve operating device not having a variable lift mechanism.

In all of the above embodiments, the connecting pin connecting the rocker cam to the second link is provided in the driving cam portion, but the connecting pin may be provided in the lift restricting cam portion.

INDUSTRIAL APPLICABILITY

According to the invention described above, irregular valve motion in an intake valve or an exhaust valve of an internal combustion engine can be prevented reliably, regardless of a rocking acceleration of a rocker cam. Accordingly, this invention exhibits particularly favorable effects when applied to a variable valve device of an internal combustion engine for an automobile.

The embodiments of this invention in which an exclusive property or privilege is claimed are defined as follows:

The invention claimed is:

1. A valve operating device that opens and closes a valve of an internal combustion engine by driving a valve stem in an axial direction, comprising:

a rocker cam that rocks in accordance with a rotation of a drive shaft which is synchronized with a rotation of the internal combustion engine, the rocker cam comprising a driving cam portion and a lift restricting cam portion;

a cam follower that lifts the valve by contacting the driving cam portion slidingly so as to convert a rocking of the rocker cam into an axial direction motion of the valve stem; and a restricting member that prevents the cam follower from separating from the driving cam portion in cooperation with the lift restricting cam portion, the restricting member and the cam follower being formed integrally in a rocker arm; and a valve spring configured to bias the valve stem in a valve closing direction to maintain the cam follower in contact with the driving cam portion, wherein a gap is formed between the restricting member and the rocker cam in a state where the cam follower is in contact with the driving cam portion and disappears such that the restricting member and the rocker cam come into contact with each other only when the cam follower separates from the driving cam portion opposing a spring force of the valve spring.

2. The valve operating device as defined in claim 1, wherein the restricting member prevents the cam follower from separating from the rocker cam by contacting the lift restricting cam portion.

3. The valve operating device as defined in claim 1, wherein the restricting member and the lift restricting cam portion are constituted to be capable of preventing the cam follower from separating from the rocker cam at least in a section in which an acceleration of the rocker cam in a valve stem driving direction is negative.

4. The valve operating device as defined in claim 1, wherein the driving cam portion of the rocker cam and the lift restricting cam portion overlap in an orthogonal direction to the drive shaft of the rocker cam.

5. The valve operating device as defined in claim 4, wherein the rocker cam is constituted by a single cam formed integrally with the driving cam portion and the lift restricting cam portion.

6. The valve operating device as defined in claim 1, wherein the rocking center of the rocker cam is positioned between the center line of the valve stem and a straight line parallel to the center line of the valve stem, which passes through the rocking center of the rocker arm in a rocking plane of the rocker cam.

7. The valve operating device as defined in claim 1, wherein the rocking center of the rocker arm is constituted by a pivot pin.

8. The valve operating device as defined in claim 1, wherein a rocking center of the rocker arm is constituted by a drive shaft disposed parallel to the drive shaft of the rocker cam.

9. The valve operating device as defined in claim 1, wherein a recessed portion for preventing interference with the lift restricting cam portion when the rocker cam rocks is provided on the rocker arm between the restricting member and the sliding contact portion between the cam follower and the driving cam portion.

10. The valve operating device as defined in claim 1, wherein the rocker arm comprises a rotary body on the contact portion with the rocker cam.

11. The valve operating device as defined in claim 1, wherein the rocker arm comprises a pair of sub-arms that support the valve stem from either side of a direction of a center line of the valve stem, and the pair of sub-arms are constituted such that, in accordance with a rocking direction of the rocker cam, the valve is lifted via one of the sub-arms and the other sub-arm drives the valve in an opposite direction to a lift direction.

12. The valve operating device as defined in claim 1, further comprising a variable lift mechanism that varies a lift amount of the valve.

13. The valve operating device as defined in claim 1, wherein the valve operating device is constituted such that when the rocker cam rocks in a single direction, the rocker arm drives the valve stem in a valve lift direction against the valve spring, and when the rocker cam rocks in an opposite direction, the rocker arm reduces a driving force applied to the valve stem, thereby allowing the valve stem to displace in an opposite direction to the lift direction according to a biasing force of the valve spring.

14. A valve operating device that opens and closes a valve of an internal combustion engine by driving a valve stem in an axial direction, comprising:

a rocker cam that rocks in accordance with a rotation of a drive shaft which is synchronized with a rotation of the internal combustion engine, the rocker cam comprising a driving cam portion and a lift restricting cam portion;

a cam follower that lifts the valve by contacting the driving cam portion slidingly so as to convert a rocking of the rocker cam into an axial direction motion of the valve stem; and a restricting member that prevents the cam follower from separating from the driving cam portion in cooperation with the lift restricting cam portion, the restricting member and the cam follower being formed integrally in a rocker arm, wherein the driving cam portion of the rocker cam and the lift restricting cam portion overlap in an orthogonal direction to the drive shaft of the rocker cam, the driving cam portion lifts the valve by driving the valve stem in a separating direction from the drive shaft of the rocker cam, and a sliding contact portion between the driving cam portion and the cam follower is positioned closer to a center line of the valve stem than a center of the drive shaft.

15. The valve operating device as defined in claim 14, wherein the rocker cam rocks in a direction for causing the sliding contact portion between the driving cam portion and the cam follower to approach the center line of the valve stem in a period extending from a state in which the valve is not lifted to a point at which an acceleration of a displacement of the valve stem in a lift direction of the valve reaches a maximum value.

16. The valve operating device as defined in claim 15, wherein the driving cam portion and the lift restricting cam portion are positioned on opposite sides of a rocking center of the rocker cam.

17. A valve operating device that opens and closes a valve of an internal combustion engine by driving a valve stem in an axial direction, comprising:

a rocker cam that rocks in accordance with a rotation of a drive shaft which is synchronized with a rotation of the internal combustion engine, the rocker cam comprising a driving cam portion and a lift restricting cam portion;

a cam follower that lifts the valve by contacting the driving cam portion slidingly so as to convert a rocking of the rocker cam into an axial direction motion of the valve stem; and a restricting member that prevents the cam follower from separating from the driving cam portion in cooperation with the lift restricting cam portion, the restricting member and the cam follower being formed integrally in a rocker arm, wherein a distance from an intersection between a normal of the driving cam portion on the sliding contact portion between the driving cam portion and the cam follower and a normal of the restricting member on a contact portion between the lift restricting cam portion and the restricting member to a rocking center of the rocker arm is greater than a distance from the rocking center of the rocker cam to the rocking center of the rocker arm.

18. A valve operating device that opens and closes a valve of an internal combustion engine by driving a valve stem in an axial direction, comprising:

a rocker cam that rocks in accordance with a rotation of a drive shaft which is synchronized with a rotation of the internal combustion engine, the rocker cam comprising a driving cam portion and a lift restricting cam portion;

a cam follower that lifts the valve by contacting the driving cam portion slidingly so as to convert a rocking of the rocker cam into an axial direction motion of the valve stem; and a restricting member that prevents the cam follower from separating from the driving cam portion in cooperation with the lift restricting cam portion, the restricting member and the cam follower being formed integrally in a rocker arm, wherein the driving cam portion lifts the valve by driving the valve stem in a separating direction from the drive shaft of the rocker cam, and a sliding contact portion between the driving cam portion and the cam follower is positioned farther from a center line of the valve stem than a rocking center of the drive shaft of the rocker cam.

19. The valve operating device as defined in claim 18, wherein the rocker cam rocks in a direction for causing a sliding contact portion between the driving cam portion and the cam follower to approach a rocking center of the rocker arm in a period extending from a state in which the valve is not lifted to a point at which an acceleration of a displacement of the valve stem in a lift direction of the valve reaches a maximum value.

20. The valve operating device as defined in claim 18, wherein the driving cam portion and the lift restricting cam portion are connected smoothly such that the rocker cam has a shape that simply bulges outward with no recessed portion.

21. The valve operating device as defined in claim 18, wherein a distance from an intersection between a normal of the driving cam portion on the sliding contact portion between the driving cam portion and the cam follower and a normal of the restricting member on a contact portion between the lift restricting cam portion and the restricting member to the rocking center of the rocker arm is smaller than a distance from a rocking center of the rocker cam to the rocking center of the rocker arm.

22. A valve operating device that opens and closes a valve of an internal combustion engine by driving a valve stem in an axial direction, comprising:

a rocker cam that rocks in accordance with a rotation of a drive shaft which is synchronized with a rotation of the internal combustion engine, the rocker cam comprising a driving cam portion and a lift restricting cam portion;

a cam follower that lifts the valve by contacting the driving cam portion slidingly so as to convert a rocking of the rocker cam into an axial direction motion of the valve stem; and a restricting member that prevents the cam follower from separating from the driving cam portion in cooperation with the lift restricting cam portion, the restricting member and the cam follower being formed integrally in a rocker arm, wherein, when the cam follower is in sliding contact with the driving cam portion, the lift restricting cam portion and the restricting member oppose each other via a predetermined small gap only in the vicinity of a maximum lift of the valve.

23. A valve operating device that opens and closes a valve of an internal combustion engine by driving a valve stem in an axial direction, comprising:

a rocker cam that rocks in accordance with a rotation of a drive shaft which is synchronized with a rotation of the internal combustion engine, the rocker cam comprising a driving cam portion and a lift restricting cam portion;

a cam follower that lifts the valve by contacting the driving cam portion slidingly so as to convert a rocking of the rocker cam into an axial direction motion of the valve stem; and a restricting member that prevents the cam follower from separating from the driving cam portion in cooperation with the lift restricting cam portion, the restricting member and the cam follower being formed integrally in a rocker arm, wherein, when the cam follower is in sliding contact with the driving cam portion, the lift restricting cam portion and the restricting member oppose each other via a predetermined small gap at all times.

24. A valve operating device that opens and closes a valve of an internal combustion engine by driving a valve stem in an axial direction, comprising:

a rocker cam that rocks in accordance with a rotation of a drive shaft which is synchronized with a rotation of the internal combustion engine, the rocker cam comprising a driving cam portion and a lift restricting cam portion;

a cam follower that lifts the valve by contacting the driving cam portion slidingly so as to convert a rocking of the rocker cam into an axial direction motion of the valve stem; and a restricting member that prevents the cam follower from separating from the driving cam portion in cooperation with the lift restricting cam portion, the restricting member and the cam follower being formed integrally in a rocker arm, wherein two cam followers and two restricting members which slidingly contact two rocker cams that rock synchronously are formed integrally with the rocker arm, and the rocker arm is supported by a single rocking fulcrum.

25. A valve operating device that opens and closes a valve of an internal combustion engine by driving a valve stem in an axial direction, comprising:

a rocker cam that rocks in accordance with a rotation of a drive shaft which is synchronized with a rotation of the internal combustion engine, the rocker cam comprising a driving cam portion and a lift restricting cam portion;

a cam follower that lifts the valve by contacting the driving cam portion slidingly so as to convert a rocking of the rocker cam into an axial direction motion of the valve stem; and a restricting member that prevents the cam follower from separating from the driving cam portion in cooperation with the lift restricting cam portion, the restricting member and the cam follower being formed integrally in a rocker arm, an eccentric cam that rotates integrally with the drive shaft;

a first link that is driven by the eccentric cam;

a variable lift mechanism including a control shaft formed parallel to the drive shaft and an eccentric cam portion formed integrally with the control shaft;

a connecting arm that is supported by the eccentric cam portion and rocks using the eccentric cam portion as a fulcrum in accordance with a displacement of the first link; and a second link that connects the connecting arm to the rocker cam and causes the rocker cam to rock about the drive shaft in accordance with a rocking of the connecting arm, wherein the variable lift mechanism varies the lift of the valve in accordance with a rotation position operation of the eccentric cam portion performed via the control shaft.

26. The valve operating device as defined in claim 24, wherein a connecting portion between the second link and the rocker cam is provided on the driving cam portion and positioned closer to the center line of the valve stem than a rocking center of the drive shaft.

27. The valve operating device as defined in claim 25, wherein a connecting portion between the second link and the rocker cam is provided on the lift restricting cam portion and positioned farther from the center line of the valve stem than the center of the drive shaft.

28. A valve operating device that opens and closes a valve of an internal combustion engine by driving a valve stem in an axial direction, comprising:

a rocker cam that rocks in accordance with a rotation of a drive shaft which is synchronized with a rotation of the internal combustion engine, the rocker cam comprising a driving cam portion and a lift restricting cam portion;

a cam follower that lifts the valve by contacting the driving cam portion slidingly so as to convert a rocking of the rocker cam into an axial direction motion of the valve stem; and a restricting member that prevents the cam follower from separating from the driving cam portion in cooperation with the lift restricting cam portion, the restricting member and the cam follower being formed integrally in a rocker arm, wherein a gap is formed between the restricting member and the rocker cam in a state where the cam follower is in contact with the driving cam portion and disappears such that the restricting member and the rocker cam come into contact with each other only when the cam follower separates from the driving cam portion.

* * * * *